US007188779B2

(12) United States Patent
Alles

(10) Patent No.: US 7,188,779 B2
(45) Date of Patent: Mar. 13, 2007

(54) ZONE CLIMATE CONTROL

(75) Inventor: Harold Gene Alles, Lake Oswego, OR (US)

(73) Assignee: Home Comfort Zones, Beaverton, OR (US)

( * ) Notice: Subject to any disclaimer, the term of this patent is extended or adjusted under 35 U.S.C. 154(b) by 178 days.

(21) Appl. No.: 10/873,921

(22) Filed: Jun. 22, 2004

(65) Prior Publication Data

US 2004/0238653 A1 Dec. 2, 2004

Related U.S. Application Data

(63) Continuation-in-part of application No. 10/249,198, filed on Mar. 21, 2003, now Pat. No. 6,983,889.

(51) Int. Cl.

| | |
|---|---|
| ***F24D 19/00*** | (2006.01) |
| ***F24F 11/00*** | (2006.01) |
| ***F24F 7/00*** | (2006.01) |
| ***F25D 17/00*** | (2006.01) |

(52) U.S. Cl. ..... 236/1 B; 236/49.3; 236/91 E; 62/179; 165/205; 165/212; 700/277

(58) Field of Classification Search ..... 236/1 B, 236/49.3, 91 D, 91 E, 91 R; 62/178, 179, 62/180; 165/205, 212; 700/277
See application file for complete search history.

(56) References Cited

U.S. PATENT DOCUMENTS

| | | | | |
|---|---|---|---|---|
| 4,071,745 | A * | 1/1978 | Hall | 700/16 |
| 4,089,462 | A * | 5/1978 | Bradford | 236/68 B |
| 4,531,573 | A * | 7/1985 | Clark et al. | 165/216 |
| 5,245,835 | A * | 9/1993 | Cohen et al. | 62/159 |
| 5,400,852 | A * | 3/1995 | Nakae et al. | 165/205 |
| 5,810,245 | A * | 9/1998 | Heitman et al. | 236/49.3 |
| 6,378,317 | B1 * | 4/2002 | Ribo | 62/186 |
| 6,415,617 | B1 * | 7/2002 | Seem | 62/186 |
| 6,782,945 | B1 * | 8/2004 | Eisenhour | 165/203 |
| 7,017,827 | B2 * | 3/2006 | Shah et al. | 236/1 B |

* cited by examiner

*Primary Examiner*—Marc Norman
(74) *Attorney, Agent, or Firm*—Blakely Sokoloff Taylor & Zaffman

(57) ABSTRACT

A zone climate control system and method of its operation. A zone can be a single room. A method for determining which zones' vents are to be closed, and which are to be opened, in performing heating or cooling, circulation to heat or cool a zone by mixing its air with air from another zone, circulation to reduce excessive conditioning of a zone by mixing its air with air from another zone, or circulation to maintain air quality. Airflow, thermal capacity, heating or cooling requirements, and other parameters are developed for each zone by measurement and/or derivation. Plenum pressure is predicted and managed.

30 Claims, 8 Drawing Sheets

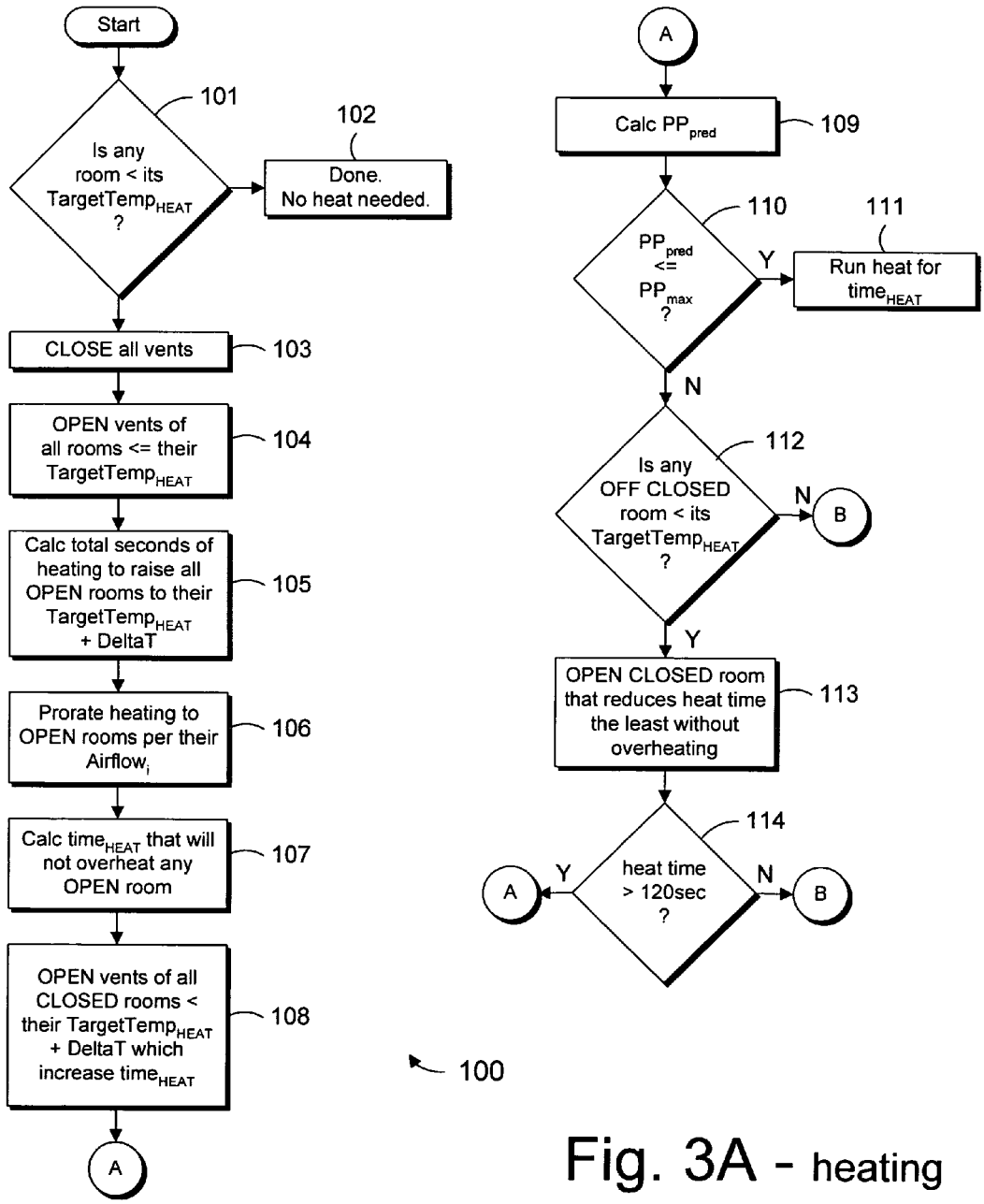
Fig. 3A - heating

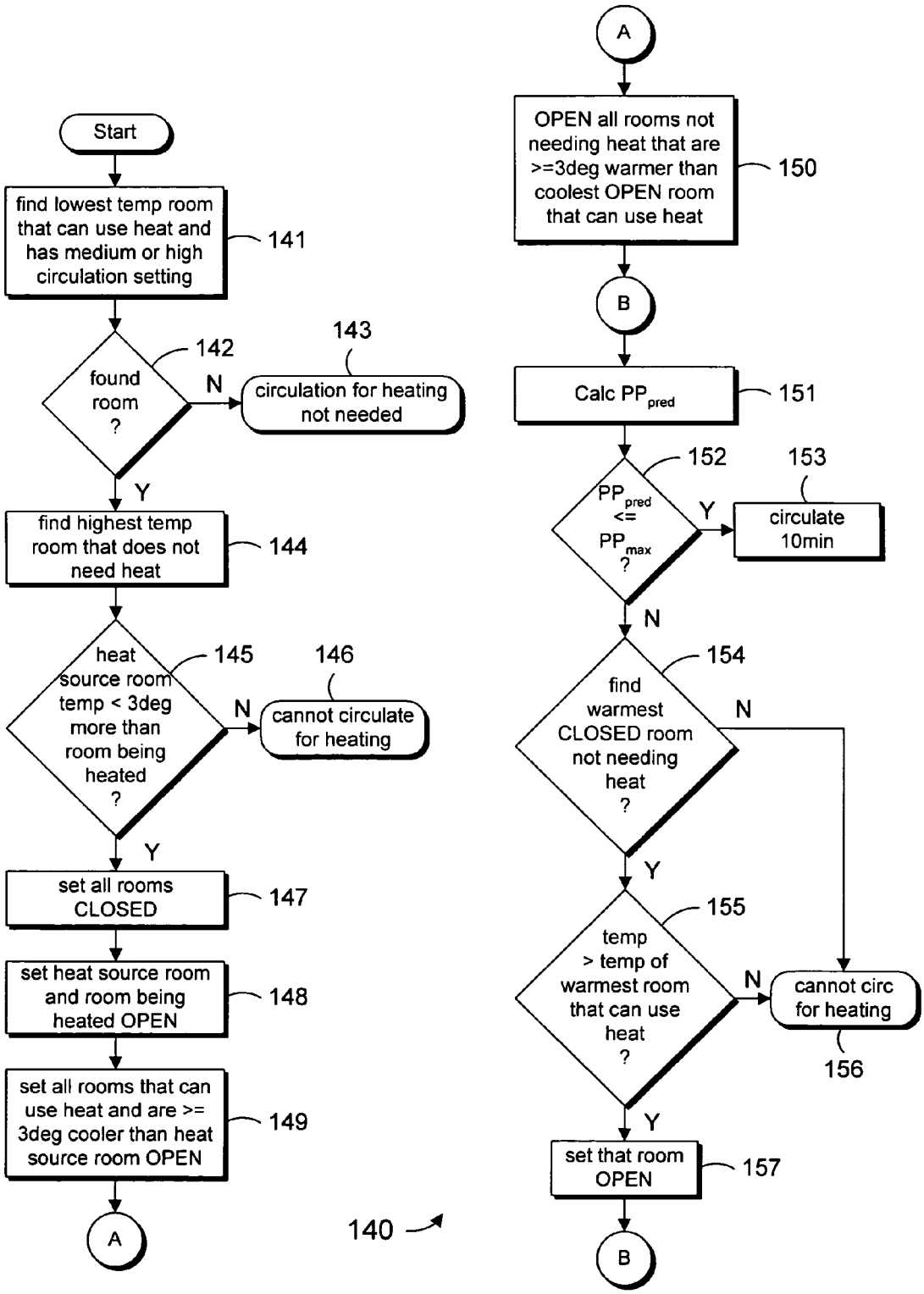
Fig. 4 - circulation for heating

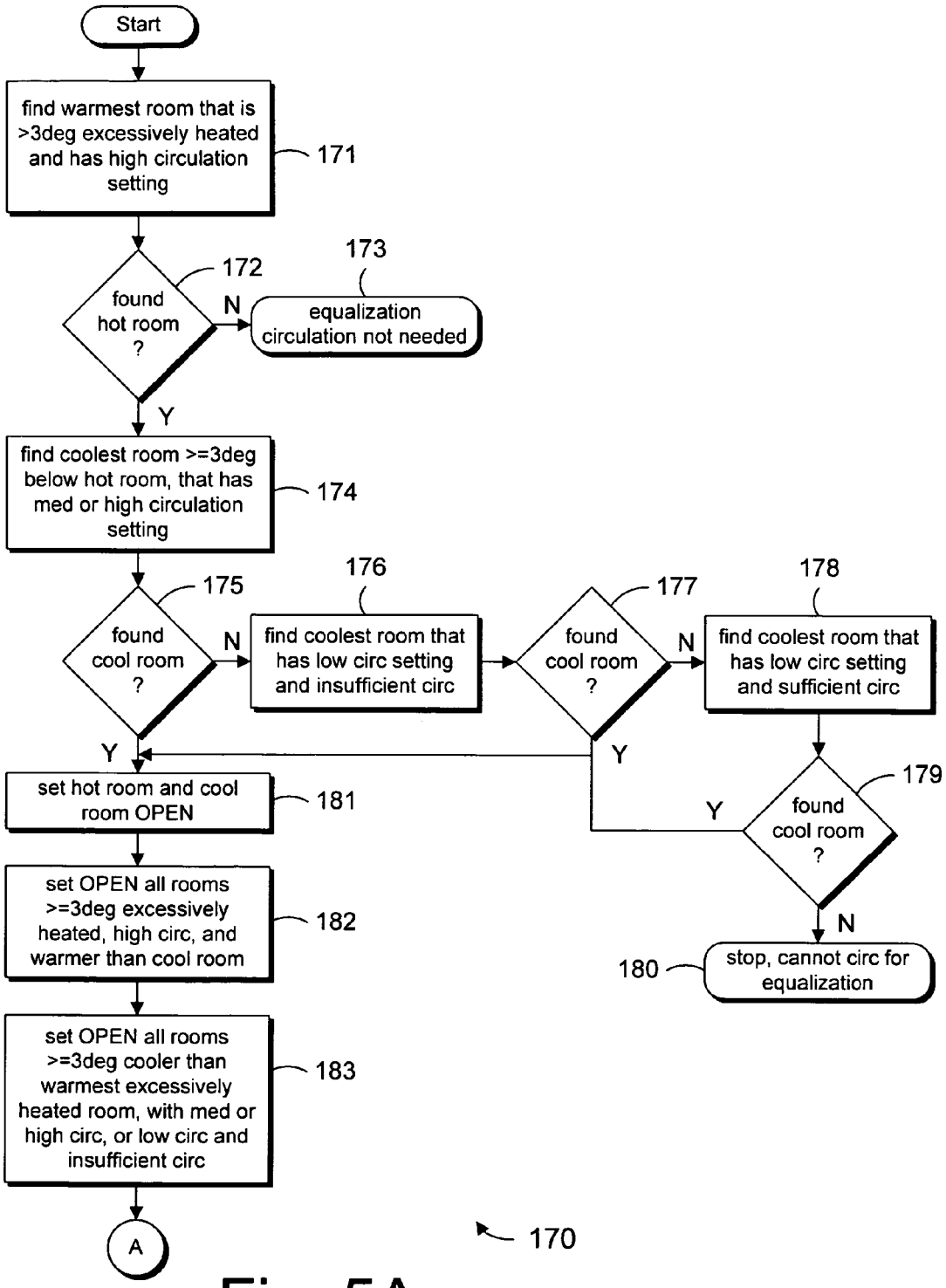
Fig. 5A - circulation for equalization

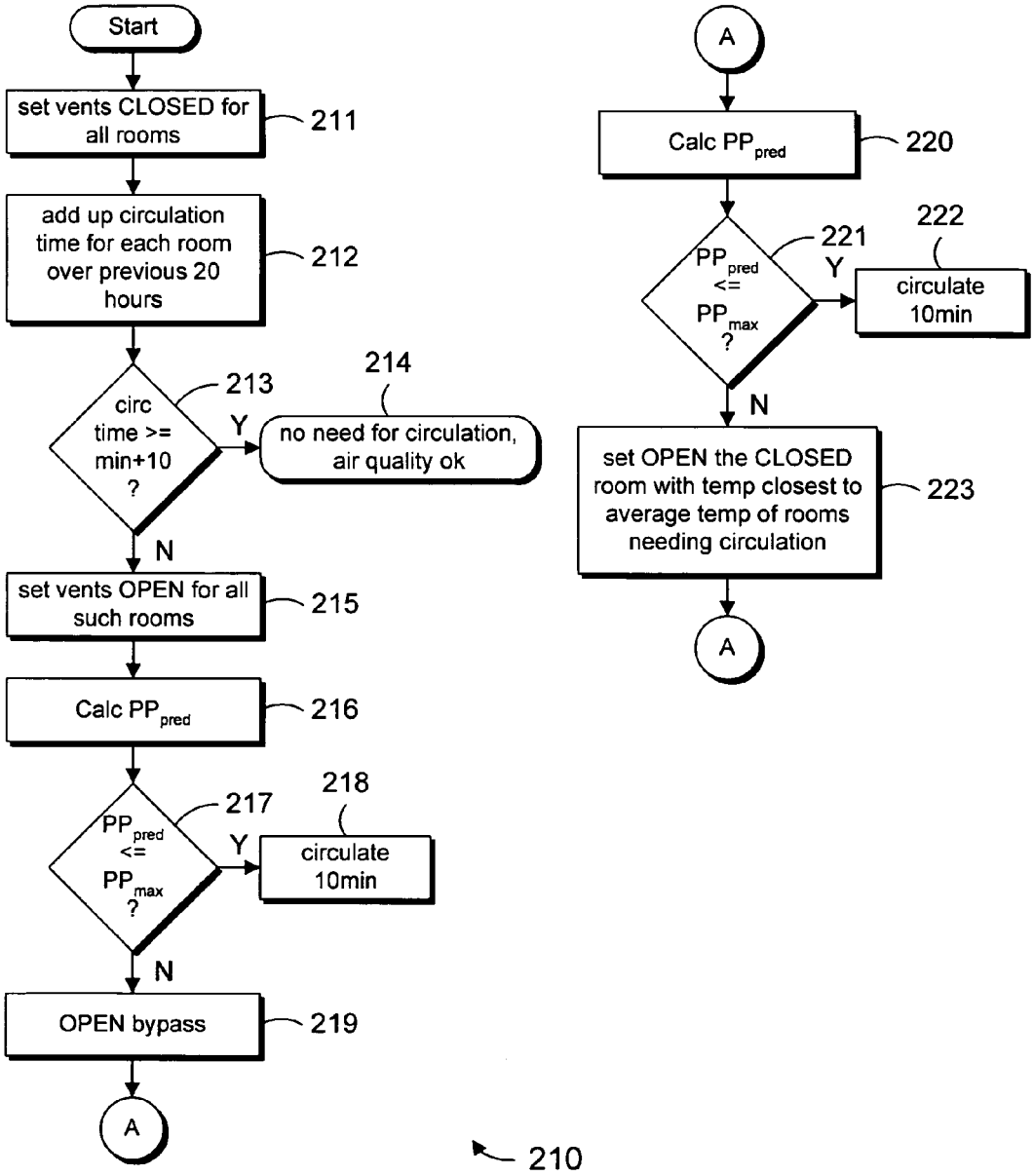
Fig. 6 - circulation for air quality

ZONE CLIMATE CONTROL

RELATED APPLICATION

This application is a continuation-in-part of, and claims filing date priority of, application Ser. No. 10/249,198 entitled "An Improved Forced-Air Climate Control System for Existing Residential House" filed Mar. 21, 2003 now U.S. Pat. No. 6,983,889 by this inventor.

BACKGROUND OF THE INVENTION

1. Technical Field of the Invention

This invention relates generally to HVAC zone climate control systems, and more specifically to a zone climate control system for room-by-room climate control in a residential building.

2. Background Art

The majority of single-family houses in the United States have forced air central heating systems. Many of these also have air conditioners that use the same air distribution system. These heating, ventilation, and air conditioning (HVAC) systems are typically controlled by a single, centrally located thermostat. The thermostat controls the HVAC equipment to maintain a constant temperature at the thermometer. The temperatures in other rooms of the house are not actively controlled, so the temperatures in different rooms can differ by many degrees from the temperature at the thermostat.

Manually adjusting the airflow to each room, by opening or closing louvers behind the vents, is the primary method available to control the temperature away from the thermostat. However, the temperatures away from the thermostat depend on many dynamic factors such as the season (heating or cooling), the outside temperature, radiation heating and cooling through windows, and the activities of people and equipment in the rooms. The desired temperature also depends on the activity of the occupant, for example lower temperatures for sleeping and higher temperatures for relaxing. Maintaining comfortable temperatures requires constant adjustment, or may not be possible.

These temperature control problems are well known to HVAC suppliers, installers, and house occupants. Zone control systems have been developed to improve temperature control. Typically, a small number of thermostats are located in different areas of the house, and a small number of mechanized airflow dampers are placed in the air distribution ducts. A control unit dynamically controls the HVAC equipment and the airflow to simultaneously control the temperatures at each thermostat. These conventional systems are difficult to retrofit, and provide limited function and benefit. They are provided by several companies such as: Honeywell, 101 Columbia Road, Morristown, N.J. 07962; Carrier, One Carrier Place, Farmington, Conn. 06034; Jackson Systems, LLC100 E. Thompson Rd., Indianapolis, Ind. 46227; Arzel Zoning Technology, Inc., 4801 Commerce Parkway, Cleveland, Ohio 44128; Duro Dyne, 81 Spence Street, Bay Shore, N.Y. 11706; and EWC Controls, Inc., 385 Highway 33, Englishtown, N.J. 07726.

U.S. Pat. No. 5,772,501 issued Jun. 30, 1998 to Merry, et al. describes a system for selectively circulating unconditioned air for a predetermined time to provide fresh air. The system uses conventional airflow control devices installed in the air ducts and the system does not use temperature difference to control circulation. This system is difficult to retrofit and does not exploit selective circulation to equalize temperatures U.S. Pat. No. 5,024,265 issued Jun. 18, 1991 to Buchholz, et al. describes a zone control system with conventional thermostats located in each zone. This system teaches one method for distributing conditioned air to zones based dependent on the zone that has the greatest need for conditioning. However, the thermostats make on-off requests for conditioning based on local set points, so the system must deduce need based on the duty cycle of on-off requests. The control system does not have access to the actual temperature in the zone nor any other characteristic of the zone such as thermal resistance or thermal capacity. This system is not practically adaptable to a residential system.

U.S. Pat. No. 5,949,232 issued Sep. 7, 1999 to Parlante describes a method for measuring the relative energy used by each unit of many units served by a single furnace based on the accumulated time each unit draws energy. The method prorates the total based on time and does not account for different rates of energy use by each unit. The method requires individual timers for each unit and a method for communicating times to a central location. The method does not provide accurate results when each unit draws energy at different rates from the common source, and is not adaptable to a residential zone controlled forced air HVAC system.

U.S. Pat. No. 6,349,883 issued Feb. 26, 2002 to Simmons, et al. describes a control system for a set of zones that draw energy from a common supply. The system claims to save energy using occupant sensors and parameters entered locally in each zone to request conditioning only when the zone is occupied. The system does not have a centralized way to specify and control the zones as groups or as an entire house, and the system is not practical for residential retrofit or use.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIGS. 3A and 3B show one method for heating, by which the HVAC controller may determine which vents to open, whether a heating cycle may be performed, and for how long.

FIG. 4 shows one method of circulation for heating, used for warming up some rooms without running the heater.

FIGS. 5A and 5B show one method of circulation for temperature equalization, used for correcting over-conditioning of some rooms.

FIG. 6 shows one method of circulation for maintaining air quality.

OUTLINE

I. Zone Climate Control
A. Forced Air Central HVAC Systems
B. Retrofit Zone Climate Control System
II. Thermal Model
A. Parameters
1. Room Parameters
2. HVAC System Parameters
3. House Parameters 4. Delta Values
B. Stored Data
1. Short Term Data Storage
a. Room Short Term Data
b. HVAC System Short Term Data
c. House Short Term Data
2. Long Term Data Storage
a. Room Long Term Data
b. HVAC System Long Term Data
c. House Long Term Data
C. Calibrating the Thermal Model Using the Stored Data
III. Operating Methodology
A. Initial Installation
B. Temperature Control
1. Heating
2. Cooling
C. Circulation
1. Circulation for Heating
2. Circulation for Cooling
3. Circulation to Reduce Over-Conditioning
4. Circulation for Air Quality
D. Anticipation The zone climate control system, thermal model, and operating methodology will be described with reference to specific embodiments and, in the interest of conciseness, will focus more on heating than on cooling. The invention is, of course, not limited to these specific details, which are provided for the reader's convenience and education only.

I. Zone Climate Control

A. Forced Air Central HVAC Systems

Figure 1:
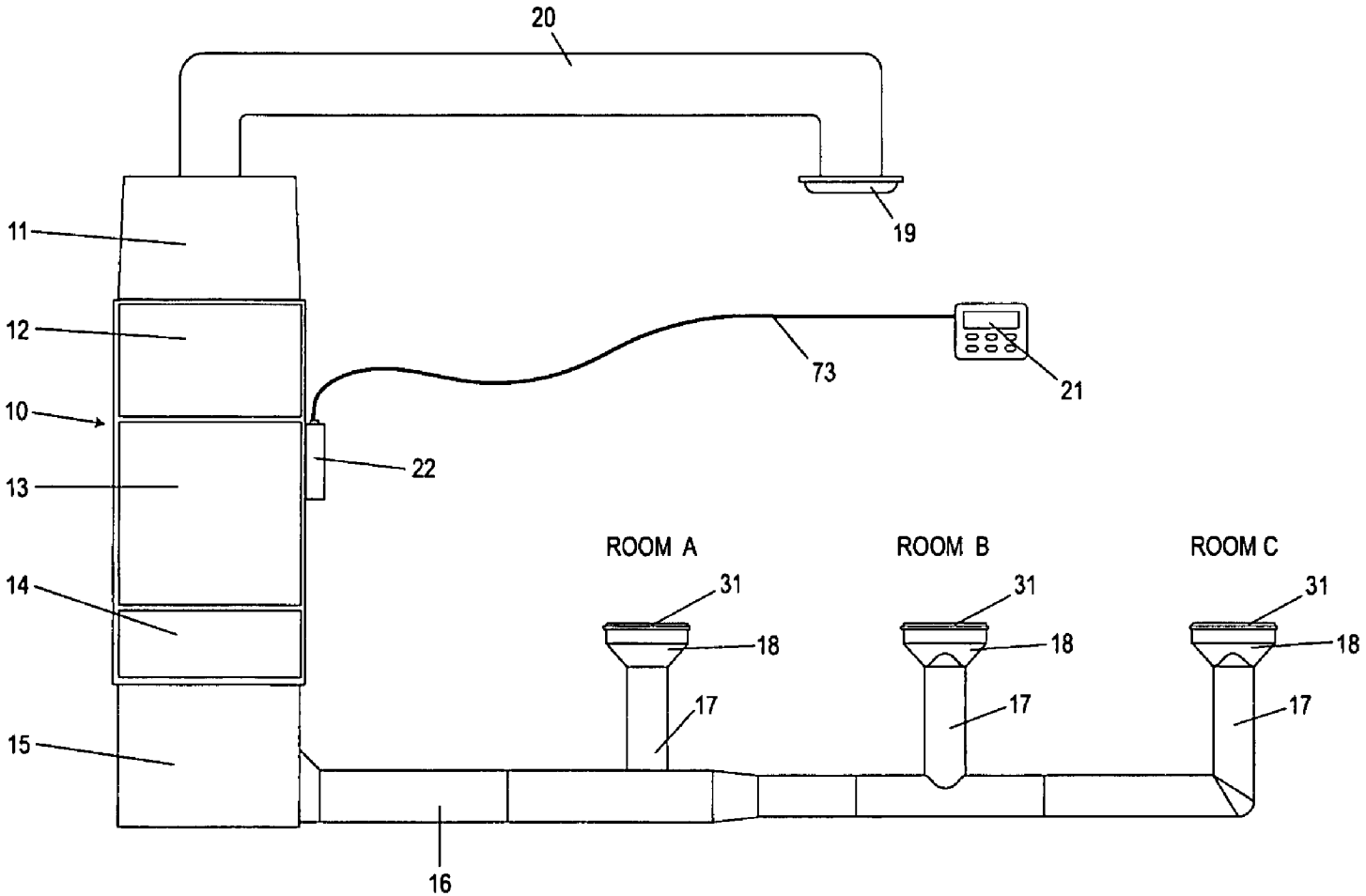
FIG. 1 shows a conventional residential forced-air HVAC system.

FIG. 1 is a block diagram of a typical forced air system. The existing central HVAC unit 10 is typically comprised of a return air plenum 11, a blower 12, a furnace 13, an optional heat exchanger for air conditioning 14, and a conditioned air plenum 15. The configuration shown is called "down flow" because the air flows down. Other possible configurations include "up flow" and "horizontal flow". A network of air duct trunks 16 and air duct branches 17 connect from the conditioned air plenum 15 to each air vent 18 in room A, room B, and room C. Each air vent is covered by an air grill 31. Although only three rooms are represented in FIG. 1, the invention is designed for larger houses with many rooms and, typically, at least one air vent in each room. The conditioned air forced into each room is typically returned to the central HVAC unit 10 through one or more common return air vents 19 located in central areas. Air flows through the air return duct 20 into the return plenum 11.

A thermostat 21 is connected by a multi-conductor cable 73 to an HVAC controller 22 that switches power to the blower, furnace and air conditioner. The thermostat commands the blower and furnace or blower and air conditioner to provide conditioned air to cause the temperature at the thermostat to move toward the temperature set at the thermostat.

FIG. 1 is only representative of many possible configurations of forced air HVAC systems found in existing houses. For example, the air conditioner can be replaced by a heat pump that can provide both heating and cooling, eliminating the furnace. In some climates, a heat pump is used in combination with a furnace. The present invention can accommodate the different configurations found in most existing houses.

B. Retrofit Zone Climate Control Systems

Figure 2:
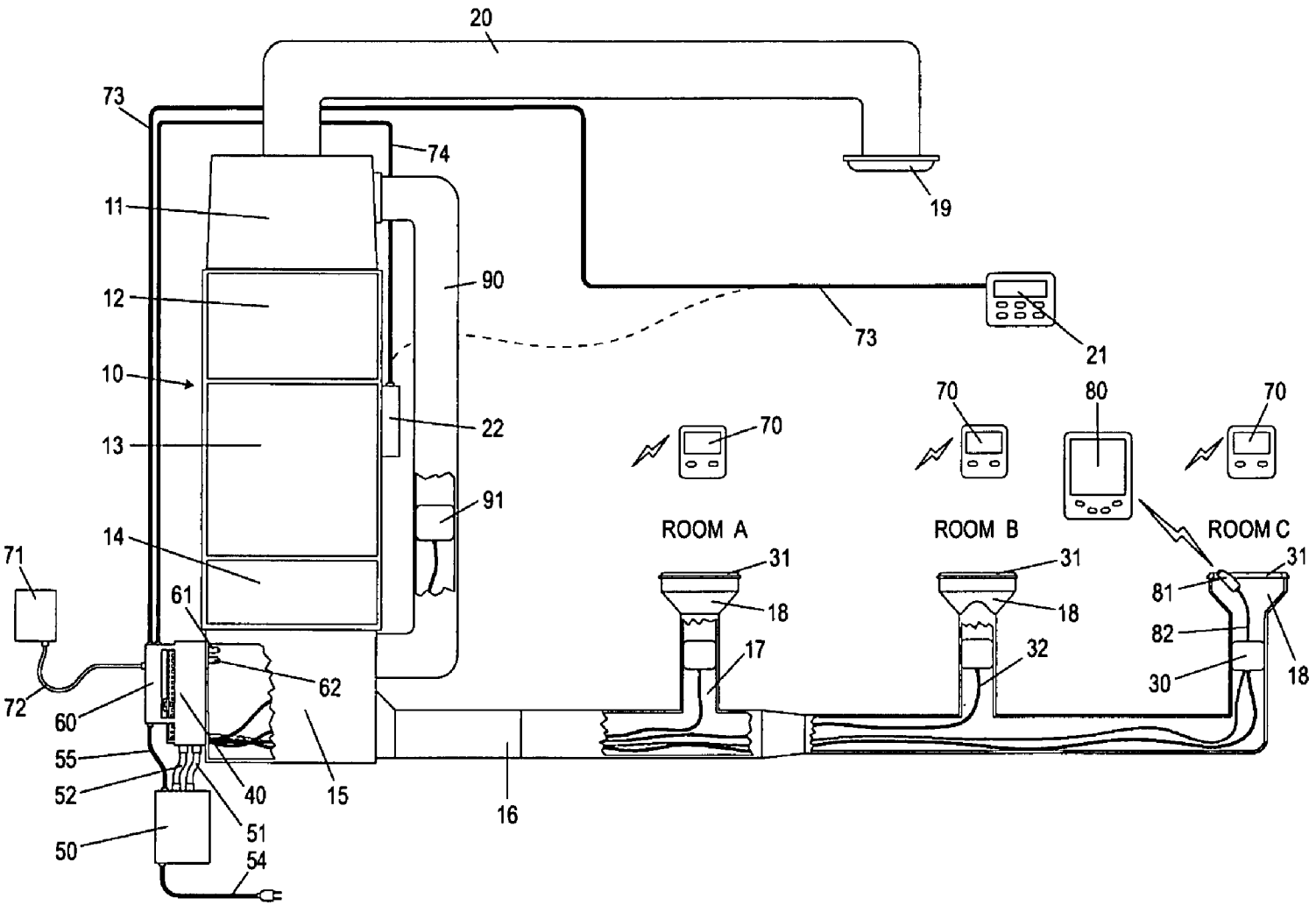
FIG. 2 shows the zone climate control system as retrofitted into the HVAC system.

FIG. 2 is a block diagram of one embodiment of the present invention installed in an existing forced air HVAC system, such as that shown in FIG. 1. The airflow through each vent is controlled by a substantially airtight bladder 30 mounted behind the air grill 31 covering the air vent 18. The bladder is, ideally, either fully inflated or fully deflated while the blower 12 is forcing air through the air duct 17. A small air tube 32 (~0.25" OD) is pulled through the existing air ducts to connect each bladder to one air valve of a plurality of servo controlled air valves 40. In one embodiment, the air valves are mounted on the side of the conditioned air plenum 15. There is one air valve for each bladder, or, in some embodiments, one air valve for each set of commonly-acting bladders (such as, for example, if there are multiple vents in a single room).

A small air pump in air pump enclosure 50 provides a source of low-pressure (~1 psi) compressed air and vacuum at a rate of e.g. ~1.5 cubic feet per minute. The pressure air tube 51 connects the pressurized air to the air valves 40. The vacuum air tube 52 connects the vacuum to the air valves. The air pump enclosure also contains a low voltage (typically 5 or 12 volts) power supply and control circuit for the air pump. The AC power cord 54 connects the system to 110V AC power. The power and control cable 55 connect the low voltage power supply to the control processor and servo controlled air valves and connect the control processor 60 to the circuit that controls the air pump. The control processor controls the air valve servos to set each air valve to one of two positions. The first position connects the compressed air to the air tube so that the bladder inflates. The second position connects the vacuum to the air tube so that the bladder deflates.

A wireless thermometer 70 is placed in each room in the house. All thermometers transmit, on a shared radio frequency of 418 MHz, packets of digital information that encode 32-bit digital messages. A digital message includes a unique thermometer identification number, the temperature, and command data. Two or more thermometers can transmit at the same time, causing errors in the data. To detect errors, the 32-bit digital message is encoded twice in the packet. The radio receiver 71 decodes the messages from all the thermometers, discards packets that have errors, and generates messages that are communicated by serial data link 72 to the control processor. The radio receiver can be located away from the shielding effects of the HVAC equipment if necessary, to ensure reception from all thermometers.

The control processor is connected to the existing HVAC controller 22 by the existing HVAC controller connection 74. The existing thermostat 21 is replaced by a graphical display 80 with a touch sensitive screen. The graphical display is connected to the processor using the same wires that had been used by the existing thermostat. Therefore, no new wires need be installed through the walls. The program executing in the processor controls the graphical display and touch screen to provide the occupant a convenient way to program the temperature schedules for the rooms and to display useful information about energy usage and the operation of the HVAC system.

The control processor controls the HVAC equipment and the airflow to each room according to the temperature reported for each room and according to an independent temperature schedule for each room. The temperature schedules specify a heat-when-below-temperature and a cool-when-above-temperature for each minute of a 24-hour day. A different temperature schedule can be specified for each day for each room.

The present invention can set the bladders so that all of the airflow goes to a single air vent, thereby conditioning the air in a single room. This could cause excessive air velocity and noise at the air vent and possibly damage the HVAC equipment. This is solved by connecting a bypass air duct 90 between the conditioned air plenum 15 and the return air plenum 11. A bladder 91 is installed in the bypass 90 and its air tube is connected to an air valve 40 so that the control processor can enable or disable the bypass. The bypass provides a path for the excess airflow and storage for conditioned air. The control processor is interfaced to a temperature sensor 61 located inside the conditioned air plenum. The control processor monitors the conditioned air temperature to ensure that the temperature in the plenum does not go above a preset temperature when heating or below a preset temperature when cooling, and ensures that the blower continues to run until all of the heating or cooling has been transferred to the rooms. This is important when bypass is used and only a portion of the heating or cooling capacity is needed, so the furnace or air conditioner is turned only for a short time. Some existing HVAC equipment has two or more heating or cooling speeds or capacities. When present, the control processor controls the speed control and selects the speed based on the number of air vents open. This capability can eliminate the need for the bypass.

A pressure sensor 62 is mounted inside the conditioned air plenum and interfaced to the control processor. The plenum pressure as a function of different bladder settings is used to deduce the airflow capacity of each air vent in the system and to predict the plenum pressure for any combination of air valve settings. The airflow to each room and the time spent heating or cooling each room is use to provide a relative measure of the energy used to condition each room. This information is reported to the house occupants via the graphical display screen.

This brief description of the components of the present invention installed in an existing residential HVAC system provides an understanding of how independent temperature schedules are applied to each room in the house, and the improvements provided by the present invention. The following discloses the details of each of the components and how the components work together to proved the claimed features.

II. Thermal Model

A. Parameters

The present invention uses one instance of a first set of parameters to describe and control the climate control of each respective room, and to make energy usage calculations regarding that room. In this context, a "room" is defined as a portion of a house associated with a particular smart controller (wireless thermometer 70). In one embodiment, there may be up to 32 rooms. The invention also uses one instance of a second set of parameters to describe and control the operation of each HVAC system in the house. In one embodiment, there may be up to 5 HVAC systems. The invention also uses a third set of parameters to describe and control the entire house. Customarily, any given room gets its conditioned air supply from a single, predetermined one of the HVAC systems. In other words, the room's ductwork is connected to exactly one HVAC system. This is not a necessary limitation on the invention, although for convenience the house will be described in such terms herein.

The parameters are either measured, or derived from data measured while controlling the HVAC systems, and they become more accurate over time, as more data are gathered and factored into the derivation. Upon initial installation, default values may be utilized. In some embodiments, the default values may be customized to suit the particular house and/or local climate.

Before explaining the climate control methodology and its algorithms in detail, it will be useful to the reader to have an understanding of the data, parameters, and values used by such.

1. Room Parameters

In one embodiment, there are eight parameters associated with each room:

a. Current Temperature

Naturally, the current temperature in the room has the most significant impact on whether the HVAC system will be run. If the temperature does not need to be changed in order to bring the room into a specified target temperature range, then the room will not be the cause of the HVAC system being turned on.

b. Airflow

The airflow parameter is a unit-less value indicating the relative portion of the airflow that goes to a particular room compared to the total airflow in the plenum of the HVAC system. The bypass vent also has an airflow parameter associated with it. The airflow value is used in predicting plenum pressure for any combination of open and closed air vents, and in prorating energy usage to each room. The airflow value is always used in a ratio or with a calibrated scale factor, so it has no units and its absolute value is not important. In one embodiment, the average value of the airflow parameter for each room in the house is chosen to be an integer value of 100, and each airflow parameter will typically be within the range of 30 to 300, corresponding to airflows of 0.3 to 3 times the average airflow. The range can, of course, vary depending on the specific duct system.

Plenum pressure is predicted according to the equation:

$$PP = \frac{K_{HVAC}}{(Airflow_i + Airflow_j \ldots + Airflow_n)}$$

where:

PP is the predicted plenum pressure.

$K_{HVAC}$ is one of a set of calibration or scaling factors determined during installation of the HVAC system which includes the plenum whose pressure is being predicted and which supplies conditioned air to this room. There is a different $K_{HVAC}$ scaling factor for each HVAC function, because the fan is typically set up to run at different speeds for heating, cooling, and circulation. These specific factors are $K_{HEAT}$, $K_{COOL}$, and $K_{CIR}$, and the appropriate one is used as $K_{HVAC}$ in predicting plenum pressure, according to which type of HVAC function is to be performed. Some HVAC systems have two or more selectable heating or cooling rates. For these systems, a separate $K_{HVAC}$ factor is used for each rate to account for different fan speeds.

$Airflow_X$ is the airflow parameter of each room or bypass which has its vents set open. $Airflow_{bypass}$ is included if the bypass is open, because the bypass contributes to lowering plenum pressure.

In typical residential HVAC systems, the plenum pressure should be limited to ~0.5" to 1.0" $H_2O$ (inches of water), equivalent to ~0.018 to 0.36 psi (pounds per square inch). In one embodiment of the invention, it is beneficial to use only integer arithmetic for all calculations. Therefore inches-$H_2O$ is scaled by 1,000 to be "thousandths of inches of water" so that the maximum plenum pressure typically has an integer value of 500 to 1,000. For example, if four average rooms ($Airflow_X$=100) must be turned on to make the plenum pressure equal 500, then the value of $K_{HVAC}$ is 200,000=500*(100+100+100+100). The measured plenum pressure is scaled in a corresponding way, so that when the plenum pressure is 0.5" $H_2O$, the measured value used in calculations is 500.

The parameter $Airflow_X$ for each room and for the bypass is determined using a set of measured plenum pressures for a set of predetermined combinations of room and bypass vent settings. The process for determining $Airflow_{bypass}$ for the bypass is the same as for rooms, so in the following description, the bypass is treated as an additional room. The combinations are generated by representing the OPEN/CLOSED states of the vent(s) in rooms as bits in a circular binary array. Suppose there are n−1 rooms and a bypass. The binary array then has n elements and the elements are numbered 1, 2, . . . , n. The array is indexed using modulo arithmetic, so that an index value of n+1 accesses element 1, n+2 accesses element 2, etc. Thus, indexing is "circular" so that the end connects to the beginning. When the value of an element is 0, the air vent of the corresponding room is CLOSED (room is CLOSED). When the element has a value of 1, the air vent of the corresponding room is OPEN (room is OPEN).

Two groups of combinations are generated. The A group starts with j=n/3 (rounded down to an integer) rooms OPEN, and n-j rooms CLOSED. The B group starts with n-j rooms OPEN and j rooms CLOSED. The first combination in the A group sets rooms 1 through j OPEN and rooms j+1 through n CLOSED, and the plenum pressure $PP_{A1:J}$ is measured. The second combination in the A group additionally sets room j+1 OPEN, and the plenum pressure $PP_{A1:j+1}$ is measured. The third combination sets room 1 CLOSED, and the plenum pressure $PP_{A2:j+1}$ is measured, the fourth combination sets room j+2 OPEN and the plenum pressure $PP_{A2:j+2}$ is measured. Setting the next room OPEN, followed by setting the last room CLOSED sequentially generates the combinations. The difference between successive combinations is one additional room OPEN, or one previously OPEN room CLOSED. The number of rooms OPEN alternates between j and j+1. 2n such A group combinations are generated until the combination repeats. B group combinations are generated in the same way, beginning with rooms 1 through n-j set OPEN. The number of rooms set OPEN alternates between n-j and n-j+1. 2n such B group combinations are generated. The following is an example for 6 rooms with the nomenclature for the 24 measured plenum pressures and the corresponding combinations in the 6 element binary array:

| A Group | | B Group | |
|---|---|---|---|
| $PP_{A1:2}$ | 110000 | $PP_{B1:4}$ | 111100 |
| $PP_{A1:3}$ | 111000 | $PP_{B1:5}$ | 111110 |
| $PP_{A2:3}$ | 011000 | $PP_{B2:5}$ | 011110 |
| $PP_{A2:4}$ | 011100 | $PP_{B2:6}$ | 011111 |
| $PP_{A3:4}$ | 001100 | $PP_{B3:6}$ | 001111 |
| $PP_{A3:5}$ | 001110 | $PP_{B3:7}$ | 101111 |
| $PP_{A4:5}$ | 000110 | $PP_{B4:7}$ | 100111 |
| $PP_{A4:6}$ | 000111 | $PP_{B4:8}$ | 110111 |
| $PP_{A5:6}$ | 000011 | $PP_{B5:8}$ | 110011 |
| $PP_{A5:7}$ | 100011 | $PP_{B5:9}$ | 111011 |

-continued

| A Group | | B Group | |
|---|---|---|---|
| $PP_{A6:7}$ | 100001 | $PP_{B6:9}$ | 111001 |
| $PP_{A6:8}$ | 110001 | $PP_{B6:10}$ | 111101 |

This combination generating method yields 4n pressure measurements to determine n airflow values. Each room is OPEN and CLOSED an equal number of times, and there are 4 pairs of measurements for each room where the difference is only that one room. Using the equation for predicting plenum pressure, a typical pair of equations is:

$$PP_{Ak:i-1}=k_{HAVC}/\text{sum}(\text{Airflow}_{k:i-1})$$

$$PP_{Ak:i}=k_{HAVC}/(\text{sum}(\text{Airflow}_{k:i-1})+\text{Airflow}_i)$$

This pair can be combined to eliminate the term: sum ($Airflow_{k:i-1}$), the combined airflow for the common set of rooms that are OPEN for the two measurements. The resulting equation is:

$$\text{Airflow}_i=(k_{HAVC}/PP_{Ak:i})-(k_{HAVC}/PP_{Ak:i-1})$$

Since $k_{HAVC}$ is a common scale factor, it can be conveniently selected so that the average $Airflow_i$ term is about 100 and so that integer arithmetic can be used for the calculations. A value of 200,000 for $Airflow_i$ can be used (as described above), so the equation produces a calibrated value for $Airflow_i$. Three other pairs of plenum pressure measurements can be used to find independent measurements of $Airflow_i$:

$PP_{Ai:k}$ With $PP_{Ai+1:k}$ $PP_{Bi:k}$ with $PP_{Bi+1:k}$ $PP_{Bk:i-1}$ with $PP_{Bk:i}$.

Each pair yields a value of $Airflow_i$ for a different set of rooms in combination with the $i^{th}$ room. The airflow may be slightly different for different combinations because rooms may share the same trunk duct so that the room airflows are somewhat dependent on each other. Using the average of the four values partially compensated for such dependencies.

Energy usage is prorated according to the equation:

$$PE_i = \frac{Airflow_i}{(Airflow_i + Airflow_j + \ldots + Airflow_n)}$$

where:

$PE_i$ is the energy prorated to the $room_i$; and $Airflow_X$ is the airflow parameter of each room which has its vent OPEN. The bypass is not included, because it does not materially contribute to energy usage.

The value of PE is bounded 0<PE<=1, and thus represents a unit-less percentage of energy usage attributed to the particular room.

c. Heat Capacity

The heat capacity, $Capacity_{HEAT}$, is the time in seconds the furnace must run to raise the temperature of the room by 1 degree. $Capacity_{HEAT}$ considers only the ability of the room to hold heat energy and the ability of the furnace to produce heat, and is independent of thermal losses or gains caused by differences between inside and outside temperatures.

d. Cool Capacity

The cool capacity, $Capacity_{COOL}$, is the time in seconds the air conditioning must run to lower the temperature of the room by 1 degree, and is similar in nature to $Capacity_{HEAT}$.

e. Heat Offset

The heat offset, $TempOffset_{HEAT}$, is an empirical correction factor derived from stored operating data that corrects for secondary heat sources such as sunlight through a window, incandescent lights, appliances, and thermal coupling to other heated rooms. Its units are seconds per hour.

f. Heat Loss Factor

The heat loss factor, $LOSS_{HEAT}$, represents the amount of heat required to keep the room at a specific temperature, and is determined according to the equation:

$$Loss_{HEAT}=TempOffset_{HEAT}+(Temp_{room}-Temp_{outside})*UF_{HEAT}$$

where:

$LOSS_{HEAT}$ is the time in seconds the furnace would have to run per hour to supply the heat needed to maintain a constant room temperature. This value assumes that all of the furnace's heat could be sent to this one room; this cannot happen in most systems since the plenum pressure would be too high. Therefore, when the $LOSS_{HEAT}$ factor is actually used, it is scaled by the prorated airflow being provided to the room.

$TempOffset_{HEAT}$ is as described above.

$Temp_{room}$ is the current temperature in the room.

$Temp_{outside}$ is the current temperature outside the house.

$UF_{HEAT}$ is an empirical energy usage factor, derived from operating data. It is related to the reciprocal of the more familiar insulation "R factor". $UF_{HEAT}$ represents the rate of increase in energy usage needed to keep a room at the target temperature as the outside temperature drops. Its units are seconds per hour per degree.

The calculated $LOSS_{HEAT}$ value is valid only if it has a positive value. If it is zero or negative, the outside temperature is not low enough for the room to need heat.

g. Cool Offset

The cool offset factor, $TempOffset_{COOL}$, is an empirical factor similar to $TempOffset_{HEAT}$, and corrects for sources of heating and cooling. A source of cooling could be a basement room kept cool by the ground and having little thermal contact with the outside air.

h. Cool Loss Factor

The cool loss factor, $LOSS_{COOL}$, represents the amount of cooling required to keep the room at a specific temperature, and is determined according to the equation:

$$Loss_{COOL}=TempOffset_{COOL}+(Temp_{room}-Temp_{outside})*UF_{COOL}$$

where:

$LOSS_{COOL}$ is the time in seconds the air conditioner must run per hour to supply the cooling to maintain a constant room temperature. When it is used, it is scaled by the prorated airflow.

$Temp_{room}$ is the current temperature of the room.

$Temp_{outside}$ is the current outside temperature.

$UF_{COOL}$ is an empirical factor, derived from operating data, which represents the rate of energy usage needed to keep the room at the target temperature as the outside temperature increases. Its units are seconds per hour per degree. Its sign is negative, since ($Temp_{room}-Temp_{outside}$) becomes more negative as the outside temperature increases.

The calculated $LOSS_{COOL}$ value is valid only if it has a positive value. If it is zero or negative, the outside temperature is not high enough for the room to need cooling.

Typical rooms have sources of heating, so $LOSS_{HEAT}$ becomes positive only if the outside temperature is several degrees cooler than the target temperature ("heat when below" temperature) for heating. Likewise, $LOSS_{COOL}$ becomes positive when the outside temperature is several degrees cooler than the target temperature for cooling ("cool when above" temperature).

2. HVAC System Parameters

Many residential HVAC systems use different fan speeds for the different HVAC functions. For example, the fan speed is lowest for the circulation function, higher for the heating function, and highest for the cooling function. Since the plenum pressure increases as fan speed increases, the plenum pressure $K_{HVAC}$ scale factors $K_{HEAT}$, $K_{COOL}$, and $K_{CIR}$, are different for the functions as described above. The calibration process is done using the circulation function, so $K_{CIR}$ is arbitrarily set to a value of 200,000. $K_{HEAT}$ and $K_{COOL}$ are then determined by comparing the measured plenum pressure for the heating and cooling functions with the predicted plenum pressure using $K_{CIR}$.

3. House Parameters

The thermal behavior of the house as a whole is the composite of the behaviors of all of the rooms. Therefore there is a set of six corresponding thermal parameters for the whole house: $Capacity_{HEAT}$, $TempOffset_{HEAT}$, $UF_{HEAT}$, $Capacity_{COOL}$, $TempOffset_{COOL}$, and $UF_{COOL}$, which are used to calculate $LOSS_{HEAT}$ and $LOSS_{COOL}$, and to control the HVAC equipment to achieve the desired temperatures in each of the rooms. There is no separate Airflow factor for the whole house.

4. Measuring $Capacity_{HEAT}$ and $Capacity_{COOL}$

When the outside temperature is cold enough to require heating of a room, the room is heated (by warm air flow) for a period of time and its temperature increases. The room is then unheated for a period of time while the $Capacity_{HEAT}$ of the room supplies the heat lost to the outside (and perhaps to other rooms) and its temperature decreases. After some period of time, the temperature will have decreased sufficiently such that heating is again required for the room. The time between the heating cycles, and the difference between the outside temperature and the room temperature, can be used to calculate the heat lost ($LOSS_{HEAT}$) during that period. The $Capacity_{HEAT}$ is then (heat lost)/(room temperature change). This is more accurate if the average of the $LOSS_{HEAT}$ at the beginning of the period and the $LOSS_{HEAT}$ at the end of the period is used. Using the average is important when the outside temperature changes significantly during the measurement period.

In one embodiment, parameters are measured and stored for each room as the system controls the heating cycles according to the temperatures in the rooms. A $Capacity_{HEAT}$ is calculated for each room and for each time period between the heating cycles for that room. (Since rooms are heated only when needed, the time period between cycles is typically different for different rooms.) During each 24-hour period, the individual measurements of $Capacity_{HEAT}$ are accumulated, and at the end of the 24-hour period, the average $Capacity_{HEAT}$ is calculated for each room and is stored into long term storage.

This method of measuring $Capacity_{HEAT}$ is meaningful only if the room continuously cools between heating cycles, the change in temperature between cycles is sufficient to be measured accurately, and the environment (outside air temperature and activity in the room) has not changed significantly between heating cycles. In one embodiment, the temperature measurement has a resolution of 0.25 degree, so the change in temperature needs to be at least 0.5 degree for the measurement to have any significance. A special case occurs when the target heat temperature is reduced. The time between heating cycles may be unusually long since the room temperature may decrease several degrees before heating is required, so it is likely the environment will change significantly before heating in again needed. However, the larger change in room temperature will produce a more accurate measurement of $Capacity_{HEAT}$. Therefore the measurement is terminated when the time since the last heat cycle exceeds two hours, and a value for $Capacity_{HEAT}$ is calculated. Considering the possible sources of error when measuring $Capacity_{HEAT}$, the measured value of $Capacity_{HEAT}$ is used in the average only if all of the following conditions are satisfied:

1. The change in room temperature is more than 0.5 degree during the measurement period.
2. The calculated $LOSS_{HEAT}$ is positive at the beginning and end of the measurement period.
3. The measured $Capacity_{HEAT}$ is greater than 10% of the average $LOSS_{HEAT}$, during the measurement period. If $Capacity_{HEAT}$ is small compared to $Loss_{HEAT}$, It does not contribute significantly to any of the methods used to control the HVAC system. This also helps prevent the average $Capacity_{HEAT}$ for the 24-hour period from being distorted by a temporary source of heat such as a fireplace.

The method for measuring $Capacity_{COOL}$ is similar. When the outside temperature is high enough to require the room to be cooled, the room temperature decreases while the room receives cool airflow. The temperature increases between cooling cycles as heat from the outside overcomes the $Capacity_{COOL}$ of the room at a rate of $LOSS_{COOL}$. $Capacity_{COOL}$ is then (heat gain)/(room temperature change).

During any 24-hour period, only $Capacity_{COOL}$ or $Capacity_{HEAT}$ may be measured. If both heating and cooling are used during the 24-hour period, the environmental conditions are extremely variable and the Capacity values measured are likely to have large errors. Therefore no value for either Capacity is stored long term.

B. Stored Data

1. Short Term Data Storage

In one embodiment, the system gathers the following data and stores it for a relatively short period of time, such as a few days. In one embodiment, the total storage for one day is set to 32 Kbytes so that one bank of flash memory can store two days of data for a maximally configured system with 32 rooms and 5 HVAC systems. In one embodiment, the system includes flash memories, operated in ping-pong fashion in which one memory or block is used until it is full, and then the other, older block is erased and used for new data.

a. Room Short Term Data

Room Temperature. For each room, the current room temperature, recorded every 6 minutes, stored as 1 byte. The daily data quantity is 32 rooms*1 sample/room*1 byte/sample*10 samples/hour*24 hours=7,680 bytes.

Room Target Temperature Changes. For each target temperature change for any given room, the following data are stored in a structure:

- The ID number of the room and the settings for quiet mode (which causes the system to use a reduced plenum pressure when this room is receiving airflow and the relative amount of circulation to use to control the temperature (low, medium, or high), etc., 1 byte.
- New target heat temperature, 1 byte.
- New target cool temperature, 1 byte.
- Transition time since midnight, scaled to 6-minute units to fit in 1 byte and match the sampling rate of the temperatures.

This structure requires 4 bytes of storage per transition. In one embodiment, 451 such structures (~16 per room in a maximally configured system)=1804 bytes are provided for one day of short term storage. These changes can be caused by daily temperature schedules (no more than 6 per day) or by button pushes at the Smart Controllers. In the very unlikely event the storage is fully used, the transitions for the remainder of the day are not stored.

b. HVAC System Short Term Data

HVAC System Cycle. For each cycle of the HVAC equipment, the following data are recorded:

- Cycle start time, in seconds since midnight, divided by 2 so it fits in 2 bytes.
- HVAC equipment duration, in seconds, stored in 2 bytes. This is the actual time the heat source or cool source used energy during the cycle.
- Dead time of the cycle, which is the difference in seconds between the total time of the cycle and the HVAC equipment duration, stored in 1 byte. This is the time used to set the airflow control valves (inflate or deflate the bladders) before the start of HVAC equipment duration plus the additional circulation time after the HVAC equipment duration to fully extract the heating or cooling inn the plenum.
- ID number (1-5) of the HVAC system running the cycle, 1 byte.
- HVAC activity type, 1 byte comprising 8 bit fields each indicating whether the HVAC cycle included the bypass, the outside air vent, and any combination of the 6 HVAC controls used turn on the fan, heating, cooling, etc.

Rooms whose vents were open for the cycle, indicated by 32 respective bit fields in a 4-byte word.

Minimum plenum pressure measured during the cycle, scaled to fit in a 1-byte value.

Maximum plenum pressure measured during the cycle, scaled to fit in a 1-byte value.

Predicted plenum pressure measured during the cycle, scaled to fit in a 1-byte value.

Minimum plenum temperature measured during the cycle, 1-byte.

Maximum plenum temperature measured during the cycle, 1-byte.

Minimum humidity measured during the cycle, 1-byte.

Maximum humidity measured during the cycle, 1-byte.

This structure uses 18 bytes of storage per HVAC cycle. In one embodiment, 1280 such structures=23,040 bytes are provided for each day of short term storage. This is sufficient for any operating conditions of a maximally configured system.

c. House Short-Term Data

Outside temperature. Current outside temperature, recorded every 6 minutes, stored as 1 byte. The daily data quantity is 1 byte/sample*10 samples/hour*24 hours=240 bytes.

Date. The year, month, and day stored in a 4-byte word. This value is only used when recovering from a power failure.

In one embodiment, the total daily short term data storage provided is:

32 *240=7,680 bytes for room temperatures

451*4=1,804 bytes for target temperature transitions

1280*18=23,040 bytes for HVAC equipment cycles 240 bytes for outside temperature 4 bytes for date Total=32,768 bytes (32 Kbytes).

2. Long-Term Data Storage

Every day, shortly after midnight, the short-term data from the previous day are processed to derive a smaller data set for longer-term storage.

a. Room Long Term Data Storage

The following data are stored for each room in the house:

Minimum temperature measured in the room, 1 byte

Maximum temperature measured in the room, 1 byte

Average temperature measured in the room, 1 byte

Average difference between the room temperature and the outside temperature (the average of the 240 differences measured during the 24-hour period), 1 byte.

Maximum negative difference between the measured room temperature and the target heat temperature, 1 byte. In other words, the most "too cold" the room was when it should have been heated.

Maximum positive difference between the measured room temperature and the target cool temperature, 1 byte. In other words, the most "too hot" the room was when it should have been cooled.

Prorated number of seconds of HVAC activity for the room, divided by 2 so it fits in 2 bytes, for each of the 6 HVAC controls, for a total of 12 bytes. This data is used to calculate the UF and Offset parameters for the thermal model.

Minimum humidity measured in the plenum when the room was receiving airflow for the HVAC cycle, 1 byte.

Maximum humidity measured in the plenum when the room was receiving airflow for the HVAC cycle, 1 byte.

Average humidity measured in the plenum when the room was receiving airflow for the HVAC cycle, 1 byte.

Average signal strength of the room's Smart Controller as measured at the central receiver, 1 byte.

The number of commands received from the room's Smart Controller, 1 byte.

Room status settings including quiet mode, circulation mode, etc., one byte.

$UF_{HEAT}$ calculate for the day, 1 byte.

$TempOffset_{HEAT}/UF_{HEAT}$ calculated for the day, 1 byte.

$UF_{COOL}$ calculate for the day, 1 byte.

$TempOffset_{COOL}/UF_{COOL}$ calculated for the day, 1 byte.

$Capacity_{HEAT}$ measurement for the day, 2 bytes.

$Capacity_{COOL}$ measurement for the day, 2 bytes.

These parameters require a total of 32 bytes per day per room, for a maximum daily data quantity of 1,024 bytes for 32 rooms.

b. HVAC System Long-Term Data Storage

The following data are stored for each of the up to 5 HVAC systems:

Data for the cycle which produced the highest plenum pressure, 18 bytes.

Data for the cycle which produced the largest difference between the predicted plenum pressure and the measured maximum plenum pressure, 18 bytes.

Data for the cycle which produced the highest plenum temperature, 18 bytes.

Data for the cycle which produced the lowest plenum temperature, 18 bytes.

Data for the cycle which produced the highest measured humidity, 18 bytes.

Data for the cycle which produced the lowest measured humidity, 18 bytes.

Total number of HVAC cycles, 1 byte.

Total number of cycles for each of the 6 HVAC controls, 6 bytes total.

Total time, in seconds/2, that each of the 6 HVAC controls were active, 12 bytes total.

Number of commands entered at the touch screen controlled by this HVAC system, 2 bytes.

This gives a total daily data quantity of 128 bytes per HVAC system, 5*128=640 bytes for 5 HVAC systems.

c. House Long-Term Data Storage

The following data are stored for the whole house:

Date (year, month, date), 4 bytes.

Control mode or program active at the end of the day, 1 byte.

Minimum outside temperature, 1 byte.

Maximum outside temperature, 1 byte.

Average outside temperature, calculated as the average of the 240 stored measurements, 1 byte.

Minimum inside temperature in any room, 1 byte.

Maximum inside temperature in any room, 1 byte.

Weighted average inside temperature in any room, based on weightings which take into account the $UF_{HEAT}$ and $UF_{COOL}$ for each room, 1 byte.

Weighted average difference between inside and outside temperature, based on the difference between each room and the outside temperature, weighted by the average of $UF_{HEAT}$ and $UF_{COOL}$ for each room, 1 byte.

Weighted average target heat to temperature, 1 byte.

Weighted average target cool to temperature, 1 byte. The weighted average target temperatures are calculated by averaging the target temperatures for each room over the 24-hour periods, and weighting them according to the UF factors for each room.

This gives a total of 14 bytes of whole-house data per day. The total daily long term data storage is 1024+540+14=1, 675 bytes. In one embodiment, 13 segments of 64 Kbytes (851,968 bytes) are allocated for long term storage, enough for 508 days.

C. Calibrating the Thermal Model Using the Stored Data

As described in the previous section, the heat loss factor, $LOSS_{HEAT}$, represents the amount of heat required to keep the room at a specific temperature, and is determined according to the equation:

$$Loss_{HEAT}=TempOffset_{HEAT}+(Temp_{room}-Temp_{outside})*UF_{HEAT}$$

This equation is a first order linear equation of the form:

$$y=a+b*x$$

Given a series of N measurements of x and y, the values of a and b can be determined using the formulas $$a=\left(\frac{1}{N}\right)*(\text{sum}(y_i)-\text{sum}(x_i)) \text{ and}$$

$$b=\frac{(\text{sum}(x_i*y_i)-a*\text{sum}(x_i))}{\text{sum}(x_i*x_i)}$$

where $\text{sum}(x_i)$ is the sum of all the x values for the N measurements.

$TempOffset_{HEAT}$ is calculated as $$TempOffset_{HEAT}=\left(\frac{1}{N}\right)*(\text{sum}(Loss_{HEAT})-\text{sum}(temp_{room}-temp_{outside}))$$

where $LOSS_{HEAT}$ is the stored prorated heating time (appropriately scaled to account for conversion from seconds to hours).

$UF_{HEAT}$ is calculated as $$UF_{HEAT}=\frac{(\text{sum}((temp_{room}-temp_{outside})-(TempOffset_{HEAT}*\text{sum}(temp_{room}-temp_{outside})))}{\text{sum}(temp_{room}-temp_{outside})}$$

The method for calculating $TempOffset_{COOL}$ and $UF_{COOL}$ is identical, except the prorated time for cooling is used to determine $LOSS_{COOL}$.

At the end of each 24-hour period, the thermal mode parameters are calculated for each room based on the short term data gathered for that day. Each cycle of HVAC activity for a room is evaluated as a pair of data values where one value is the Loss (3,600*[prorated seconds of*HVAC activity]/[time between cycles]), and the other value is the difference between the room temperature at the beginning of the cycle and the outside temperature.

At the beginning of each 24-hour period, a new set of thermal model parameters are calculated for each room, and these are used throughout the following 24-hour period. The simple average of the most recent values is used. Averaging the last 15 values smoothes day-to-day variations while compensating for systematic changes in the seasons. Other numbers of values can be averaged, depending on the dynamics of the local climate. If there are fewer than 15 values stored, then as many as are available are averaged.

Only parameter values for one of the HEAT or COOL thermal models are calculated each day. It may be necessary to search backward many months to retrieve the 15 most recent values of the "off season" thermal model. For example, in some temperate climates with short cooling seasons, it may be up to a year between the last day needing cooling of the previous season to the first day needing cooling of the new season.

III. Operational Methodology

A. Initial Installation

When the system is first installed, the Airflows value for each room is determined through the set of measurements and calculations described above in section II.A.1.b.

Default values are automatically assigned to the other six parameters: $Capacity_{HEAT}$, $UF_{HEAT}$, $TempOffset_{HEAT}$, $Capacity_{COOL}$, $UF_{COOL}$, and $TempOffset_{COOL}$. The quality of the default values is important, to make the system work as well as possible upon initial installation, to avoid customer dissatisfaction during the first few days while the system extracts calibrated values from measured data. The default values should, ideally, be customized for the local climate at that particular time of year, and for the house itself e.g. the size of the house and the quality of its insulation. These default values will typically assume that the HVAC system is properly designed. A properly designed heating system can keep the house at 70 degrees on the coldest day, and a properly designed cooling system can keep the house at 72 degrees on the hottest day. A properly designed HVAC system can heat or cool the house temperature 5 degrees per hour. A properly designed heat pump system can typically change the house temperature only 2 degrees per hour, however. For a properly designed system, the airflow to each room should be proportional to the heating and/or cooling requirements of that room; however, in practice, most houses have problems here, and sometimes they are significant problems.

Reasonable default values for the six remaining parameters are:

$$TempOffset_{HEAT}=10 \text{ degrees}$$

$$TempOffset_{COOL}=10 \text{ degrees}$$

$$UF_{HEAT}=\frac{\left(\frac{60\text{ sec}}{\text{min}}*\frac{60\text{ min}}{\text{hour}}*Airflow_i\right)}{(TargetTemp_{HEAT}-Climate_{MIN}-TempOffset_{HEAT})}$$

$$UF_{COOL}=\frac{\left(\frac{60\text{ sec}}{\text{min}}*\frac{60\text{ min}}{\text{hour}}*Airflow_i\right)}{(Climate_{MAX}+TempOffset_{COOL}-TargetTemp_{COOL})}$$

$$Capacity_{HEAT}=\frac{\frac{60\text{ sec}}{\text{min}}*\frac{60\text{ min}}{\text{hour}}}{2\text{ degrees}}*Airflow_i$$

$$Capacity_{COOL}=\frac{\frac{60\text{ sec}}{\text{min}}*\frac{60\text{ min}}{\text{hour}}}{2\text{ degrees}}*Airflow_i$$

The "5 degrees" factor is default degrees per hour the heating or cooling system can change the temperature of the whole house. This should be "2 degrees" for heat pumps.

B. Temperature Control

The temperature control method uses the thermal model, described above, to predict the conditioning time (in seconds) needed to keep all of the rooms within a predetermined number of degrees—DeltaT—of the target temperature. A reasonable default value for this global parameter may be 1 degree, but it may be changed, based on field experience, the local climate, and the homeowner's preference. When heating, it is acceptable to heat a room until its temperature is DeltaT above its target heating temperature. And when cooling, it is acceptable to cool a room until its temperature is DeltaT below its target cooling temperature.

In order to maximize the efficiency of the heating or cooling, and to minimize the number of cycles—which the occupants may find distracting, and which may stress the HVAC equipment excessively—the temperature control method attempts to make each cycle at least a minimum duration, if possible. A reasonable minimum duration may be 15 minutes. When bypass is used, it may be necessary to use a lower duration target, to avoid overheating or overcooling the plenum; therefore, the method attempts to maximize the number of open vents, and will reduce the cycle time, to avoid using the bypass, if possible.

At the start of the control cycle, the amount of heating and cooling needed for each room during the next 15 minutes is calculated, in seconds. The target temperature used for this calculation is adjusted by DeltaT. If the time value is negative, it is set to zero. In order to ensure that both heating and cooling are never required at the same time, the system may require that the $TargetTemp_{HEAT}$ be at least twice DeltaT below the $TargetTemp_{COOL}$.

In one embodiment, the $TargetTemp_{HEAT}$ and $TargetTemp_{COOL}$ are specified with 1-degree resolution, while the wireless thermometers report the current temperature with 0.25-degree resolution.

1. Heating

Figure 3B:
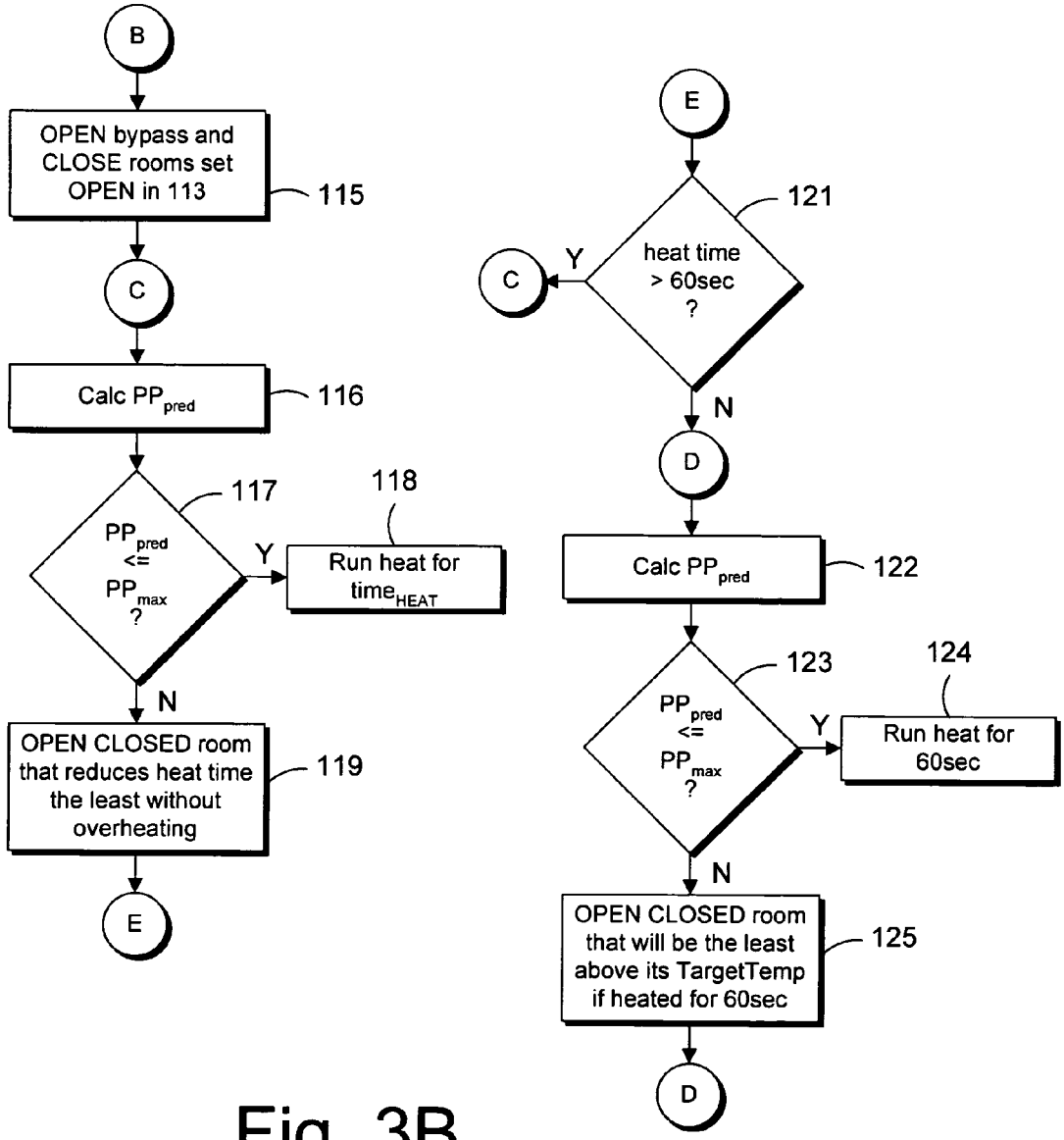

FIGS. 3A and 3B illustrate one exemplary embodiment of a method 100 of operating an HVAC system to heat rooms of a house. A similar method may be used for cooling, but for simplicity, only a heating method will be described. The room's vents are either OPEN or CLOSED, controlling whether heated air is, or is not, supplied to the room.

If (101) one or more rooms coupled to the HVAC system needs heat, meaning that the temperature reported by the room's wireless thermometer is lower than the Target $Temp_{HEAT}$ assigned to that room in the currently running program, then the heating method is undertaken. Otherwise, no heat is needed (102) and the HVAC controller can check whether cooling or circulation may be needed.

When heating is to be undertaken, the HVAC controller may begin by logically setting (103) all room vents to CLOSED. Then, the vents are set (104) to OPEN for all rooms which need heat.

The HVAC controller calculates (105) the $time_{HEAT}$ (total time), in seconds, of heating required to raise all OPEN rooms to their respective $TargetTemp_{HEAT}$ settings+DeltaT. The $time_{HEAT\text{-}ROOM}$ for each room is:

$$Capacity_{HEAT}*(TargetTemp_{HEAT}+DeltaT-\text{room temperature})+LOSS_{HEAT}$$

where $LOSS_{HEAT}$ is calculated from the equation for the room, using the current room temperature, outside temperature, and an initial time of 15 minutes (the target time between HVAC cycles). This total heating required is $time_{HEAT}$, the sum of the $time_{HEAT\text{-}ROOM}$ values for each of the rooms that need heat.

The $time_{HEAT\text{-}ROOM}$ is calculated again for each room with its vent OPEN (called an OPEN room) using the prorated (106) heat to the room using the Airflow parameters of all OPEN rooms and using $time_{HEAT}$ as the time between HVAC cycles. This compensates for the potential unequal distribution of the airflow to the OPEN rooms. The shortest of these $time_{HEAT\text{-}ROOM}$ values is the $time_{HEAT}$ that will not overheat any of the OPEN rooms. (A room is considered overheated if it is more than DeltaT warmer than its $TargetTemp_{HEAT}$.)

The HVAC controller then calculates (107) the longest duration $time_{HEAT}$ for which the heater may be run, without overheating any OPEN room.

In one embodiment of the method, the HVAC controller then attempts to maximize $time_{HEAT}$ (the duration of the heating cycle), by testing (108) all remaining CLOSED rooms with temperatures below their $TargetTemp_{HEAT}$+DeltaT. These are rooms that, although not requiring heat, could receive additional heat without becoming overheated. Each candidate room is set OPEN (one at a time), and the calculation of $time_{HEAT}$ (the minimum of all of the $time_{HEAT\text{-}ROOM}$ values) is repeated, using the adjusted prorated airflows. If making the room OPEN increases $time_{HEAT}$, then that room is left OPEN. If $time_{HEAT}$ is reduced, then that room is left CLOSED. This means that even if the room temperature is above its $TargetTemp_{HEAT}$, it may still receive additional heating, provided its final predicted temperature does not exceed $TargetTemp_{HEAT}$+DeltaT, and that including the room will increase $time_{HEAT}$.

The HVAC controller then calculates (109) the predicted plenum pressure $PP_{pred}$ according to the Airflow values of the OPEN vents. If (110) the predicted plenum pressure is less than or equal to the specified maximum plenum pressure $PP_{max}$, the heater is run (111) for the $time_{HEAT}$ duration.

If the predicted plenum pressure is too high, the HVAC controller attempts to lower the plenum pressure by various means. In one embodiment, the HVAC controller first attempts to lower the plenum pressure by sequentially opening additional room vents at the cost of reducing the $time_{HEAT}$. One at a time, for each room currently CLOSED (and not needing heat) whose temperature is lower than its $TargetTemp_{HEAT}$+DeltaT, the HVAC controller logically sets (113) the vent to OPEN and $time_{HEAT}$ is calculated again. The calculated $time_{HEAT}$ for each candidate room is compared (114), and if the longest $time_{HEAT}$ is greater than a predetermined threshold, such as 120 seconds, the HVAC controller sets the vent for that one room OPEN and goes back (A) to again predict (109) the plenum pressure.

If either there are no rooms with CLOSED vents that are below their $TargetTemp_{HEAT}$+DeltaT (112), or the $time_{HEAT}$ has fallen below the first threshold (114), the HVAC controller sets (115) the bypass to OPEN. All of the rooms previously set open (in 113) are set CLOSED, since they do not require heat this cycle, but were set OPEN only as a means of reducing plenum pressure.

The HVAC controller then again predicts (116) the plenum pressure with the bypass set OPEN. If (117) the plenum pressure is less than or equal to the maximum, the heater is run (118) for the $time_{HEAT}$ duration calculated for the rooms set OPEN. Otherwise, the HVAC controller may take further measures to try to lower the plenum pressure.

The HVAC controller sets (119) OPEN the CLOSED room that will reduce $time_{HEAT}$ the least if heated to DeltaT plus its $TargetTemp_{HEAT}$. If (121) the $time_{HEAT}$ is greater than a second threshold, e.g. 60 seconds, the HVAC controller then again predicts (116) the plenum pressure. Otherwise, the HVAC controller predicts (122) the plenum pressure and, if (123) the predicted plenum pressure is below the maximum allowed, the heater is run (124) for the second threshold of time. Otherwise, the HVAC controller (125) searches one at a time for the room currently CLOSED that would be least above its $TargetTemp_{HEAT}$ if heated for 60 seconds. That room is set OPEN and the HVAC controller returns to (122) to predict the plenum pressure. This is repeated until sufficient rooms are set OPEN so that with bypass set OPEN, the plenum pressure is less than the maximum.

In summary, the heating control process is to always provide heat to all rooms below their $TargetTemp_{HEAT}$. The $time_{HEAT}$ is maximized by also heating rooms up to DeltaT above their $TargetTemp_{HEAT}$. If the plenum pressure is too high with just these rooms set OPEN, rooms are set open one at a time, selected in the order that reduces $time_{HEAT}$ the least. Rooms are added until the plenum pressure is satisfied or until the $time_{HEAT}$ becomes less than 120 seconds. If the $time_{HEAT}$ becomes less than 120 seconds, all the rooms set OPEN that reduced the $time_{HEAT}$ are set CLOSED and the bypass is set OPEN. If the plenum pressure is not satisfied, rooms are again added one at a time selected in the order that reduces $time_{HEAT}$ the least. This is repeated until the plenum pressure is satisfied or until the $time_{HEAT}$ becomes less than 60 seconds. If $time_{HEAT}$ becomes less than 60 seconds, it is set to 60 seconds and the CLOSED rooms are search one at a time for the one room that will be the closest to its $TargetTemp_{HEAT}$ if heated for 60 seconds, and that room is set OPEN. Rooms are added one at a time until the plenum pressure is satisfied. Then the rooms now set OPEN are heated for 60 seconds.

2. Cooling

The method for cooling is similar to the method for heating, appropriately exchanging the roles of Target $Temp_{COOL}$ and $TargetTemp_{HEAT}$, and using the corresponding values and equations for $LOSS_{COOL}$ and $Capacity_{COOL}$. It is much less likely that rooms will be overcooled than overheated, because there are many sources of heating and only few sources of cooling.

C. Circulation

If neither a heating cycle nor a cooling cycle is possible, then circulation may be used to heat, cool, equalize temperatures, or maintain air quality. Four different conditions are considered for circulation:

1) Heating is needed in one or more rooms, and one or more rooms can be a source of heat.
2) Cooling is needed in one or more rooms, and one or more rooms can be a source of cool (sink of heat).
3) No room needs heating or cooling, but one or more rooms are over-conditioned (significantly above their $TargetTemp_{HEAT}$ or significantly below their $TargetTemp_{COOL}$). Circulation is used to equalize the temperature.
4) One or more rooms have not received a minimum amount of airflow to maintain air quality.

In one embodiment of the system, each temperature schedule setting for each room specifies a low, medium, or high level of circulation, which influences how circulation is used. At the low circulation setting, circulation is only used to ensure a minimum of new air is sent to the room each day, or as a last resort source of heat or cool to satisfy another room which has a high circulation setting. The low circulation setting is ordinarily only applied to rooms that are set for minimal conditioning to save energy. At the medium circulation setting, the room can be used as a source of heat or cool, but does not itself trigger circulation for equalization if its temperature is significantly greater than its Target $Temp_{HEAT}$ or significantly less than its $TargetTemp_{COOL}$; in other words, a medium circulation room accepts over-conditioning. At the high circulation setting, the room calls for circulation when it is excessively conditioned.

A room is considered excessively conditioned (different than over-conditioned) when it is more than a predetermined threshold, such as 3 degrees above its $TargetTemp_{HEAT}$ or below its $TargetTemp_{COOL}$. In some embodiments, there may be separate excessively conditioned thresholds for heating and for cooling. In some embodiments, the excessively conditioned thresholds may have seasonal adjustments; for example, a room may be excessively heated if it is 3 degrees too hot in the summer, but 5 degrees too hot in the winter.

Circulation for temperature equalization or control is only utilized when the temperature difference between the warmest and coolest participating rooms is greater than a predetermined threshold, such as 3 degrees. The bypass is not used in circulation for temperature equalization; sufficient vents are opened to prevent over-pressurizing the plenum and to maximize the effect of circulation.

Circulation for air quality is done when most cost effective. During heating season, circulation to unconditioned rooms is done in the afternoon, when the outside temperature is highest. During cooling season, circulation to unconditioned rooms is done after midnight, when the outside temperature is lowest.

1. Circulation for Heating

FIG. 4 illustrates one embodiment of a method 140 of circulation for heating, such as may be employed when a normal heating cycle is not needed because no room is yet below its $TargetTemp_{HEAT}$. The HVAC controller starts by finding (141) the lowest temperature room which can use heat (meaning it is less than DeltaT above its $TargetTemp_{HEAT}$) and which has a medium or high circulation setting. Low circulation rooms are not considered because they are minimally conditioned, and not heated until below their $TargetTemp_{HEAT}$.

If (142) such a room is not found, circulation for heating is not needed (143), and the HVAC controller can move on to evaluating the cooling needs of the house.

But if such a room is found, which is to be heated by circulation, the HVAC controller finds (144) the highest temperature room that does not need heat (is more than DeltaT above its $TargetTemp_{HEAT}$ and thus can be a source of heat. This room is potentially the heat source room for heating the cold room by circulation.

If (145) the temperature in the potential heat source room is less than a predetermined threshold, such as 3 degrees, warmer than the temperature in the room to be heated, circulation heating would not be effective (146). Otherwise, circulation heating will be attempted.

The HVAC controller logically sets (147) all rooms vents to CLOSED, sets (148) the vents of the heat source room and the room to be heated OPEN, and sets (149) to OPEN the vents of all rooms which can use heat and whose temperature is at least the threshold amount, such as 3 degrees, cooler than the heat source room.

Optionally, the HVAC controller then attempts to increase the amount of heat source, by setting (150) to OPEN all rooms which (1) do not need heat and (2) are at least the threshold amount warmer than the coolest OPEN room which can use heat.

With this baseline set of participating rooms' vents set OPEN, the HVAC controller then predicts (151) the plenum pressure. If (152) the predicted plenum pressure is less than or equal to the maximum allowed, the HVAC controller causes the HVAC system to circulate (153) the air into the participating rooms for a predetermined amount of time, such as 10 minutes. In some embodiments, the amount of time may be determined according to dynamic factors, such as the total $\text{Capacity}_{HEAT}$ of the participating rooms.

If the plenum pressure is predicted to exceed the maximum allowed pressure, the HVAC controller attempts to lower the pressure by finding (154) the warmest CLOSED room not needing heat. If (155) the temperature in that room is greater than the temperature in the warmest room that can use heat, then that room can be used as a heat source, although it may not be an especially good one, such as if its temperature is only very slightly above that in the warmest room that can use heat. The HVAC controller sets (157) that room's vent OPEN, and goes back to re-predict (151) the plenum pressure and so forth. If, after the initial or a subsequent check of the predicted plenum pressure, it exceeds the maximum pressure, and if (154) there is no other CLOSED room not needing heat or if (155) the temp of such room is too low, recirculation for heating cannot be done (156).

2. Circulation for Cooling

The method for circulation cooling is substantially similar to the method for circulation heating.

3. Circulation to Reduce Excessive Conditioning

Circulation for equalization is used to reduce excessive conditioning and to keep temperatures more equalized. It is done only for rooms having the high circulation setting.

Figure 5B:
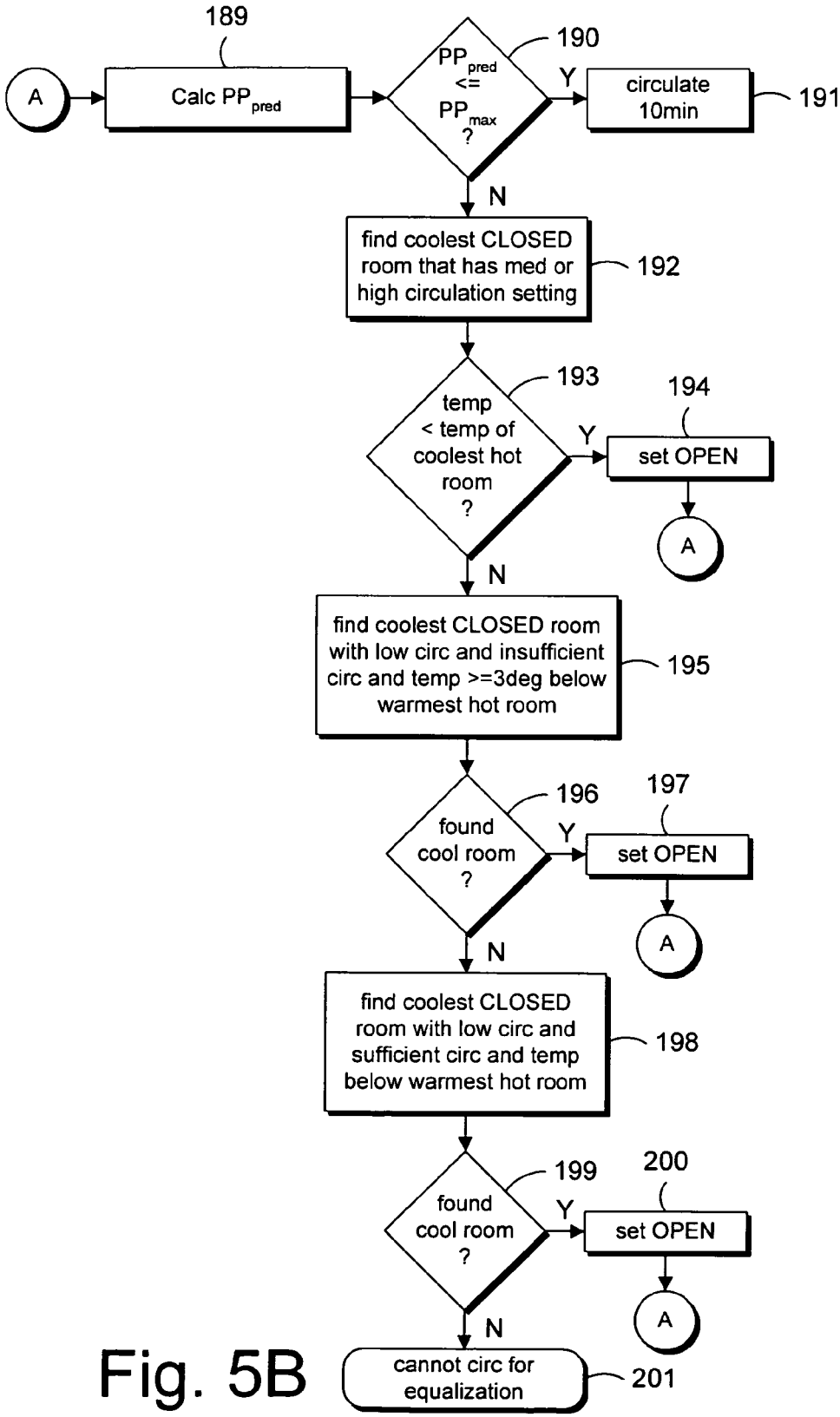

FIGS. 5A and 5B illustrate one embodiment of a method (170) of performing circulation for reducing excessive conditioning and equalizing room temperatures. The method is explained in terms of the heating function, but the same or a similar method can be employed to reduce excessive cooling, as well. Excessive cooling is less likely than excessive heating, because the house has numerous sources of supplemental heat, such as incandescent lights, appliances, an oven, a cooktop, sunlight, people, and so forth, and there are few sources of supplemental cool.

The HVAC controller starts by logically initializing all vents to CLOSED state. It then searches to find (171) the warmest room which is at least 3 degrees excessively heated and has a high circulation setting. If (172) no such room is found, circulation for equalization is not needed. Otherwise, a "hot room" has been found, which needs to be cooled down toward its $\text{TargetTemp}_{HEAT}$. The hot room temperature will be lowered by mixing hot air from the hot room with air from a cooler room, the "source of cool".

The HVAC controller tries to find (174) the coolest room which is at least 3 degrees cooler than the hot room, and which has a circulation setting of high or medium. If (175) no such room is found, the HVAC controller tries to find (176) the next preferred type of source of cool, the coolest room that has a low circulation setting and that has not had sufficient circulation yet today to maintain its air quality. If (177) no such room is found, the HVAC controller tries (178) to find the next preferred type of source of cool, the coolest room that has a low circulation setting and that has received sufficient circulation already today. If (179) no such room is found, there simply is not a suitable source of cool, and circulation for equalization cannot be performed (180).

If (175, 177, 179), however, a suitable source of cool has been found, the HVAC controller logically sets (181) the vents in that room and in the hot room OPEN. To maximize the redistribution of heat, the HVAC controller also sets (182) OPEN the vents of all rooms that are at least 3 degrees excessively heated, have the high circulation setting, and are warmer than the cool room. To maximize the effectiveness of the cooling, the HVAC controller also sets (183) OPEN the vents of all rooms that: (1) are at least 3 degrees cooler than the warmest excessively heated room, and (2) have (a) high or medium circulation settings, or (b) the low circulation setting and have not received sufficient circulation yet today.

The HVAC controller predicts (189) the plenum pressure. If (190) the predicted plenum pressure is less than or equal to the maximum allowable pressure, the fan is run (191) for a predetermined period of circulation, such as ten minutes. As air is pushed into the overheated rooms and the source of cool rooms, it will mix in the hallways etc. and in the plenum, quickly equalizing to a middle temperature cooler than the overheated rooms were and warmer than the source of cool rooms were.

If the predicted plenum pressure is too high, the HVAC controller attempts to lower it by opening more vents. The HVAC controller attempts to find (192) the coolest CLOSED room that has the medium or high circulation setting. If (193) the temperature in that room is lower than that of the coolest overheated room, the HVAC controller sets (194) that room's vents OPEN, and goes back to re-predict (189) the plenum pressure. Otherwise, the HVAC controller attempts to find (195) the coolest CLOSED room with the low circulation setting and insufficient air circulation today, which is at least 3 degrees cooler than the warmest excessively heated room. If (196) such a room is found, the HVAC controller sets (197) its vents OPEN, and goes back to re-predict (189) the plenum pressure. Otherwise, the HVAC controller attempts to find (198) the coolest CLOSED room with the low circulation setting and sufficient circulation, which is cooler than the warmest excessively heated OPEN room. If (199) such a room is found, the HVAC controller sets (200) its vents OPEN, and goes back to re-predict (189) the plenum pressure. Otherwise, there are no suitable rooms whose vents can be opened to lower the plenum pressure, and circulation for equalization cannot be performed (201).

4. Circulation for Air Quality

FIG. 6 illustrates one embodiment of a method (210) for circulating the air to maintain air quality, particularly in rooms which are set to minimal conditioning for energy savings, and therefore not conditioned each day. The HVAC controller starts by logically setting (211) all vents CLOSED. For each room, the HVAC controller goes back through its stored data for the previous period of time, such as 24 hours, and adds (212) up the total time the room received airflow. If (213) the total time for every room is above some threshold, such as some predetermined minimum, there is no need (214) for circulation, as every room has already received sufficient circulation today and will have adequate air quality.

Otherwise, the HVAC controller sets (215) OPEN the vents of all rooms which have not had sufficient circulation.

The HVAC controller predicts (216) the plenum pressure. If (217) the predicted plenum pressure is less than or equal to the maximum allowed, the HVAC controller turns on the fan to circulate (218) the air for a predetermined period of time, such as 10 minutes. In some embodiments, the period of time may be dynamically determined, such as in response to the least amount of prior circulation, or the Airflow parameters of the OPEN rooms.

If the plenum pressure will be too high, the HVAC controller sets (219) the bypass OPEN, and re-predicts (220) the plenum pressure. If (221) the plenum pressure is low enough, the HVAC controller runs the fan to circulate (222) the air for a predetermined period, such as 10 minutes. Otherwise, the HVAC controller attempts to lower the plenum pressure by opening the vents of certain rooms which do not actually need circulation.

The HVAC controller finds (223) the CLOSED room whose temperature is closest to the average temperature of the OPEN rooms. The HVAC controller sets (226) its vents OPEN, and goes back to re-predict (220) the plenum pressure.

The bypass is used in preference to using more rooms, to reduce the mixing of conditioned and unconditioned air.

D. Anticipation

The seven room parameters, and other data, are also used for providing an accurate "anticipation" function when one or more different temperature schedules ("setback") are in use. Anticipation is needed when making a transition to a new target temperature that requires an increase in energy usage—moving to a higher $\text{TargetTemp}_{HEAT}$ or a colder $\text{TargetTemp}_{COOL}$, because the user commonly understands the schedule time to specify the time at which the room should be at the new target temperature, not the time at which the HVAC system should begin heating or cooling to the new target temperature. It takes some amount of time for the HVAC system to raise or lower the house temperature, so heating or cooling must be started early, to reach the new target temperature by the specified time. Various factors will influence the amount of anticipation time needed, such as the outside temperature, the Capacity of the rooms, the number of rooms moving to a new target temperature, the Airflow available to those rooms, and so forth. The more extreme the outside temperature, the longer the anticipation time will need to be, because more of the HVAC system capacity will be needed simply to maintain the current temperature.

The anticipation function uses the thermal model described above, and looks ahead in time for the changes in target temperature that will require additional conditioning. The time when the new target temperature becomes effective is advanced sufficiently to ensure that the new target temperature is reached at or before its specified time. The anticipation function calculates an anticipation time for every room, responding to changes in room temperature and outside temperature. The anticipation function is a separate process from the HVAC temperature control process described above. The temperature control process adds the separately calculated anticipation time to the current time, and uses this adjusted time to get the target temperatures from the programmed temperature schedules. This is a simple way to cleanly separate the longer-term anticipation function from the shorter-term HVAC control function.

The anticipation function considers the capacity of the HVAC system, and the ability to use that capacity to change the temperature in each room. Even though the HVAC equipment may have sufficient capacity, it may not be possible to effectively get the capacity to the room needing the temperature change.

A portion of the total HVAC conditioning capacity is needed for keeping the rooms at their current temperatures. This is calculated by summing the $\text{LOSS}_{HEAT}$ or $\text{LOSS}_{COOL}$ for all the rooms. The excess heating capacity available to raise the temperature can be calculated as $$ExcessCapacity_{HEAT} = \frac{60\,\text{sec}}{\text{min}} * \frac{60\,\text{min}}{\text{hour}} - \text{sum}(Loss_{HEAT})$$

The excess cooling capacity is calculated similarly. As the outside temperature becomes more extreme, there is less excess capacity available for changing the room temperature.

The maximum conditioning that can be delivered to a room is proportional to the room's Airflow. When only a few rooms change target temperature at the same time, the fraction $\text{Frac}_i$ of the excess conditioning that can be delivered to a room is roughly $$Frac_i = Airflow_i * \frac{PP_{\max}}{k_{HVAC}}$$

When many rooms change target temperature at the same time, the fraction $\text{Frac}_i$ of the excess conditioning that can be delivered to a room is roughly $$Frac_i = \frac{Airflow_i}{\text{sum}(Airflow_i)}$$

The sum is taken over all the rooms that are changing target temperatures in a way that requires more conditioning at the same time. This calculation takes into account the time calculated the last time the anticipation function was executed.

The smaller of these two values of $\text{Frac}_i$ is used in calculating the anticipation. Consider the case of heating. The anticipation function first looks ahead in all the temperature schedules to find the first change in each schedule that requires additional heating to reach the target temperature, or, in other words, new target temperatures which are higher than current target temperatures. This is referred to as the TempDelta. The extra heating time $\text{ExtraTime}_{HEAT}$ (in seconds of heating) required to get the room to its new target temperature is:

$$\text{ExtraTime}_{HEAT}=\text{Capacity}_{HEAT}*\text{TempDelta}$$

The room also needs heating time to overcome the heat losses to the outside. This is calculated using the thermal model $$\text{Loss}_{HEAT}=\text{TempOffset}_{HEAT}+((\text{Temp}_{room}-\text{Temp}_{outside})*\text{UF}_{HEAT})$$

where $\text{LOSS}_{HEAT}$ is the seconds of heating per hour.

Both $\text{ExtraTime}_{HEAT}$ and $\text{LOSS}_{HEAT}$ must be prorated by the fraction of the total airflow received by the room. The maximum prorated seconds of airflow per hour the room can receive is $3{,}600*\text{Frac}_i$, so the excess airflow available to increase the temperature of the room is $3{,}600*\text{Frac}_i-\text{LOSS}_{HEAT}$. Combining these terms (including scale factors), the anticipation time (in seconds of "real time") required to supply the extra heat is $$Time_{anticipation} = \frac{\frac{60\,\text{sec}}{\text{min}} * \frac{60\,\text{min}}{\text{hour}} * ExtraTime_{HEAT}}{\frac{60\,\text{sec}}{\text{min}} * \frac{60\,\text{min}}{\text{hour}} * Frac_i - Loss_{HEAT}}$$

$$\text{Initially, } Frac_i = Airflow_i * \frac{PP_{\max}}{k_{HVAC}}$$

is used to calculate the anticipation time for each room. Then, additional iterations are made using the calculated anticipation values from the previous iteration for all other rooms, taking into account the anticipation times. The airflows for all rooms with overlapping anticipation times are summed. If $$\frac{Airflow_i}{\text{sum}(Airflow_i)} < \frac{Airflow_i * PP_{\max}}{k_{HVAC}} \text{ then}$$

$$Frac_i = \frac{Airflow_i}{\text{sum}(Airflow_i)}$$

is used, and the anticipation is recalculated. This makes the anticipation longer, so the overlap of anticipation must be checked again, and $Frac_i$ adjusted if necessary. This iteration continues until $Frac_i$ is acceptably stable for this room, such as the value changes less than 5% between iterations.

At the limits of the capacity of the heating system, the HVAC controller must limit the amount of anticipation time to some predetermined maximum, such as 4 hours.

Anticipation is regularly calculated as part of the main control loop. Anticipation has no effect when the change in target temperature is farther in the future than the anticipation value. The anticipation value strongly depends on the outside temperature, and changes as the outside temperature changes. Therefore, the anticipation value needs to be recalculated fairly frequently. For example, if the outside temperature at 4 am is 20 degrees, and there is a 5 degree increase in room temperature scheduled for 10 am, the anticipation value calculated at 4am might be 3 hours, suggesting that the heating will need to be turned on at 7 am. However, when 7 am arrives, the outside temperature may have risen to 40 degrees, resulting in an anticipation value of only 2 hours, or 8 am. In this instance, the rising outside temperature shortens the anticipation value, causing the turn-on time to recede into the future. The opposite can also happen, when a falling outside temperature causes the anticipation value to increase and the turn-on time to advance earlier and earlier. The same general methodology can be used with cooling, but with the opposite effects caused by changing outside temperatures, of course.

Conclusion

The various features illustrated in the figures may be combined in many ways, and should not be interpreted as though limited to the specific embodiments in which they were explained and shown. Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. A method for operating a zone climate control system to control a multi-zone HVAC system in a building having multiple zones conditioned by the HVAC system, the method comprising:

maintaining, for each of the zones, a thermal model which is dependent on an outside temperature, and which includes a capacity term and a loss term;

maintaining an airflow model that prorates airflow to each of the zones; and utilizing a predictive algorithm for determining when conditioning is needed.

2. The method of claim 1 wherein:

the predictive algorithm determines which zones will receive airflow.

3. The method of claim 2 wherein:

the predictive algorithm further determines a duration of a cycle of the HVAC system.

4. A method for operating a zone climate control system to control a multi-zone HVAC system in a building having multiple zones conditioned by the HVAC system, the method comprising:

maintaining a thermal model which utilizes an outside temperature and which includes a capacity term and a loss term for each of the zones; and executing a predictive algorithm upon the thermal model to determine when conditioning is needed in a zone.

5. The method of claim 4 wherein:

the predictive algorithm determines which zones will receive airflow.

6. The method of claim 5 wherein:

the predictive algorithm further determines a duration of a cycle of the HVAC system.

7. The method of claim 6 wherein:

the thermal model includes an airflow term for each of the zones.

8. The method of claim 1 wherein maintaining the thermal model comprises:

storing historical thermal model data; and deriving parameters of the thermal model from the stored historical thermal model data.

9. The method of claim 1 wherein maintaining the airflow model comprises:

predicting plenum pressure of the HVAC system.

10. The method of claim 9 wherein utilizing the predictive algorithm comprises:

selectively operating a bypass duct to control plenum pressure, in response to predicting the plenum pressure.

11. The method of claim 1 wherein utilizing the predictive algorithm comprises:

attempting to maximize the duration of the cycle without over-conditioning any zone.

12. The method of claim 1 wherein utilizing the predictive algorithm comprises:

maintaining different target temperatures in different zones.

13. The method of claim 1 wherein utilizing the predictive algorithm comprises:

maintaining a plurality of temperature schedules for the various zones.

14. The method of claim 1 wherein utilizing the predictive algorithm comprises:

utilizing an anticipation function.

15. The method of claim 14 wherein utilizing the anticipation function comprises:

adapting the anticipation function in response to changing outside temperature.

16. The method of claim 14 wherein utilizing the anticipation function comprises:

operating the anticipation function independently for each zone.

17. The method of claim 16 wherein utilizing the anticipation function comprises:

adjusting operation of the anticipation for a first zone in response to changing conditions in a second zone.

18. The method of claim 1 wherein utilizing the predictive algorithm comprises:

using only circulation without heating or cooling, to control temperature in a zone.

19. The method of claim 1 wherein utilizing the predictive algorithm comprises:

ensuring that each zone receives a predetermined minimum amount of airflow during a predetermined time period.

20. The method of claim 1 wherein:

the airflow model is calibrated during installation of the zone climate control system.

21. The method of claim 20 wherein calibrating the airflow model comprises:

measuring plenum pressure for a predetermined pattern of settings of vents in the various zones.

22. The method of claim 1 further comprising:

providing default values for parameters of the thermal model upon installation of the zone climate control system; and updating values of the parameters of the thermal model in response to usage of the thermal model over time.

23. The method of claim 1 further comprising:

calibrating the capacity term in response to the loss term.

24. The method of claim 1 further comprising:

calculating a zone's capacity term by accumulating data for each HVAC cycle received by the zone.

25. The method of claim 1 further comprising:

periodically calculating offset parameter values and usage factor parameter values according to short term and long term data stored in the thermal model.

26. The method of claim 1 further comprising:

calculating thermal model parameters by averaging recent values.

27. A method for operating a zone climate control system to control a multi-zone HVAC system in a building having multiple zones conditioned by the HVAC system, the method comprising:

maintaining a thermal model of the zones, wherein the thermal model includes for each zone a capacity term and a loss term describing thermal characteristics of the zone;

maintaining a temperature schedule for each of the zones;

measuring a current temperature in a zone;

determining, based on the temperature schedule and the measured current temperature, whether the zone will require conditioning;

if the zone is determined to require conditioning, operating the HVAC system to provide conditioning to the zone;

predicting, according to the thermal model, the measured current temperature, and the temperature schedule, a duration of an HVAC cycle for which the HVAC system is to be operated.

28. The method of claim 27 further comprising:

ending the HVAC cycle at an end of the predicted duration, regardless of whether a new current temperature in the zone can be measured.

29. The method of claim 28 wherein:

the determining further includes identifying additional zones which also will require conditioning; and the operating further includes providing conditioning to the additional zones.

30. The method of claim 29 further comprising:

identifying other zones which may be conditioned to at least one of(i) extend the duration of the HVAC cycle and (ii) decrease pressure in a plenum of the HVAC system; and providing conditioning to the other zones.

* * * * *